US007469993B2

(12) United States Patent
Murata et al.

(10) Patent No.: US 7,469,993 B2
(45) Date of Patent: Dec. 30, 2008

(54) INKJET RECORDING HEAD

(75) Inventors: Michiaki Murata, Kanagawa (JP); Hiroyuki Usami, Kanagawa (JP); Nanao Inoue, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 420 days.

(21) Appl. No.: 11/002,645

(22) Filed: Dec. 3, 2004

(65) Prior Publication Data

US 2005/0275693 A1 Dec. 15, 2005

(30) Foreign Application Priority Data

Jun. 10, 2004 (JP) ..... 2004-173169

(51) Int. Cl.
*B41J 2/14* (2006.01)
*B41J 2/045* (2006.01)

(52) U.S. Cl. ..... 347/50; 347/68

(58) Field of Classification Search ..... 347/50, 347/68–72

See application file for complete search history.

(56) References Cited

U.S. PATENT DOCUMENTS 6,099,111 A * 8/2000 Chang ..... 347/71
6,270,193 B1 * 8/2001 Hiwada ..... 347/50
6,491,384 B2 * 12/2002 Usui et al. ..... 347/70
6,572,223 B2 * 6/2003 Delametter et al. ..... 347/82
2002/0036667 A1 * 3/2002 Shingyohuchi ..... 347/11
2003/0038868 A1 * 2/2003 Arai et al. ..... 347/94

FOREIGN PATENT DOCUMENTS

JP 2-301445 12/1990
JP 9-323414 12/1997

* cited by examiner

*Primary Examiner*—Stephen D Meier
*Assistant Examiner*—Geoffrey Mruk
(74) *Attorney, Agent, or Firm*—Morgan, Lewis & Bockius LLP

(57) ABSTRACT

An inkjet recording head includes: nozzles that jet ink droplets; pressure chambers that communicate with the nozzles and contain ink; a diaphragm that configures part of the pressure chambers; an ink pool chamber that pools ink to be supplied to the pressure chambers via ink flow paths; and piezoelectric elements that cause the diaphragm to be displaced, wherein the ink pool chamber is disposed opposite from the pressure chambers with the diaphragm being disposed therebetween, and drive ICs that apply a voltage to the piezoelectric elements are mounted on a piezoelectric element substrate formed to include the diaphragm.

16 Claims, 20 Drawing Sheets

INKJET RECORDING HEAD

CROSS-REFERENCE TO RELATED APPLICATION

This application claims priority under 35 USC 119 from Japanese Patent Application No. 2004-173169, the disclosure of which is incorporated by reference herein.

BACKGROUND OF THE INVENTION

1. Field of the Invention

The present invention relates to an inkjet recording head including nozzles that jet ink droplets, a pressure chamber that communicates with the nozzles and contains ink, a diaphragm that configures part of the pressure chamber, an ink pool chamber that pools ink to be supplied to the pressure chamber via an ink droplet path, and a piezoelectric element that displaces the diaphragm.

2. Description of the Related Art

Conventionally, inkjet recording devices are known where ink droplets are selectively discharged from plural nozzles of an inkjet recording head (sometimes referred to simply as "recording head" hereinafter) that reciprocally moves in a main scanning direction, and where characters and images are printed on a recording medium such as recording paper that is conveyed in a sub-scanning direction.

In such inkjet recording devices, there are piezoelectric recording heads and thermal recording heads. In the case of the piezoelectric recording head, as shown in FIGS. 14 and 15, piezoelectric elements (actuators that convert electrical energy into mechanical energy) 206 are disposed on pressure chambers 204 to which ink 200 is supplied from an ink tank via an ink pool chamber 202, and the piezoelectric elements 206 bend and deform so that the volumes of the pressure chambers 204 are reduced, whereby the ink 200 therein is pressurized and jetted as ink droplets 200A from nozzles 208 that communicate with the pressure chambers 204.

With respect to inkjet recording heads of this configuration, in recent years there has been the demand to enable high-resolution printing while keeping the inkjet recording heads inexpensive and compact. In order to meet this demand, it is necessary to dispose the nozzles in a high density, but in present recording heads, because the ink pool chamber 202 is disposed next to the nozzles 208 (i.e., between the nozzles 208 and the nozzles 208) as illustrated, there has been a limit on disposing the nozzles 208 in a high density.

Also, a drive IC that applies a voltage to predetermined piezoelectric elements is disposed in the inkjet recording head, but conventionally, as shown in FIGS. 16A and 16B, an FPC (flexible printed circuit board) 210 is mounted thereon. In other words, bumps 212 formed on the FPC 210 are bonded to metal electrode surfaces on upper surfaces of the piezoelectric elements 206 disposed on a diaphragm 214 to connect the FPC 210.

By mounting the drive IC (not shown) on the FPC 210 in such a manner, the piezoelectric elements 206 and the drive IC are electrically connected.

Also, there is a method where electrical terminals on a mounting substrate to which the drive IC is mounted are connected by wire bonding to electrode terminals disposed on an outer surface of the recording head (e.g., see Japanese Patent Application Laid-Open Publication (JP-A) No. 2-301445).

Moreover, there is a method where the drive IC is bonded and connected to the electrode terminals disposed on the outer surface of the recording head, and thereafter the FPC is bonded and connected to electrode terminals of pull-out interconnects (wiring) disposed in the recording head (e.g., see JP-A No. 9-323414).

However, any of the above-described cases, interconnects arrangement in which a pitch between each wire is minute (e.g., 10 μm pitch or less) cannot be formed. Thus, there are problems in that when the nozzle density rises, the sizes of the mounting substrate and the FPC inevitably become large, miniaturization is inhibited and costs increase. Moreover, there is the problem that when the nozzle density rises, interconnects having a desired resistance cannot be installed as desired. In other words, there is a limit on increasing the nozzle density resulting from the restriction of the interconnects density.

SUMMARY OF THE INVENTION

In light of the above problems, the present invention provides an inkjet recording head where high densification of the nozzles and the formation of minute pitch interconnects (wiring) required for the high densification of the nozzles are both realized so that high resolution and miniaturization are achieved.

In a first aspect of the invention, an inkjet recording head includes: nozzles that jet ink droplets; pressure chambers that communicate with the nozzles and contain ink; a diaphragm that configures part of the pressure chambers; an ink pool chamber that pools ink to be supplied to the pressure chambers via ink flow paths; and piezoelectric elements that cause the diaphragm to be displaced, wherein the ink pool chamber is disposed opposite from the pressure chambers with the diaphragm being disposed therebetween, and drive ICs that apply a voltage to the piezoelectric elements are mounted on a piezoelectric element substrate formed to include the diaphragm.

In the present aspect, the pressure chambers can be disposed in mutual proximity. Thus, the nozzles disposed for each pressure chamber can be disposed in a high density. Also, by using a photolithographic technique of a semiconductor process for the formation of a metal interconnects pulled out from the piezoelectric elements, interconnects arrangement in which a pitch between each wire is 10 μm or less (which interconnects arrangement will be referred to as "minute interconnects with a pitch of 10 μm or less") can be formed. Further, the interconnects length can be shortened (which contributes to lowering the resistance of the interconnects) by connecting the interconnects to the drive ICs in the vicinity of the piezoelectric elements.

In other words, due to these configurations, the invention can accommodate the high densification of nozzles with practical interconnects resistance, thereby achieving high resolution.

In a second aspect of the invention, the nozzles are disposed in a matrix.

In the present aspect, the nozzles are disposed in a matrix. In other words, the nozzles based on the first aspect can be arranged in a form of a high-density matrix. Thus, high resolution can be realized.

In a third aspect of the invention, the drive ICs are surface-mounted on the piezoelectric element substrate.

In the present aspect, the drive ICs are surface-mounted on the piezoelectric element substrate. Thus, high-density electrical connection can be provided easily, whereby miniaturization of the recording head can be realized.

The drive ICs include two-dimensionally disposed connection terminals arranged so as to adapt to high-density electrical connection. Examples of the mounting method therefor include Ball Grid Array (BGA) mounting and flip-chip mounting. The mounting method of any suitable type may be selected depending on the required connection terminal pitch. In the case of the present invention, flip-chip mounting is most preferable from the standpoint of being able make the drive ICs thin and the standpoint of being able to form connection terminals of a pitch of high density.

In a fourth aspect of the invention, the drive ICs are disposed between the diaphragm and a top plate of the ink pool chamber.

In the present aspect, the drive ICs are disposed between the diaphragm and a top plate of the ink pool chamber. The length of the interconnects between the piezoelectric elements and the drive ICs can thus be shortened in comparison to a case where the drive ICs are mounted on an exterior portion of the recording head. In other words, the interconnects resistance can be lowered. Thus, this is a configuration suited for high densification of the nozzles.

Also, because the drive ICs are installed inside the recording head, miniaturization of the recording head can be realized.

In a fifth aspect of the invention, gaps of space in which the drive ICs are disposed, vertically between the diaphragm and the top plate, are filled in with a resin material.

In the present aspect, gaps of space in which the drive ICs are disposed, vertically between the diaphragm and the top plate, are filled in with a resin material. Thus, the bonding strength between the top plate and the piezoelectric element substrate is increased. Also, because the drive ICs are sealed with the resin material, the drive ICs can be protected from the external environment such as moisture.

In a sixth aspect of the invention, interconnects disposed at the piezoelectric element substrate and connecting the piezoelectric elements and the drive ICs are covered with a resin material.

In the present aspect, interconnects disposed at the piezoelectric element substrate and connecting the piezoelectric elements and the drive ICs are-covered with a resin material. Thus, erosion of the interconnects resulting from the ink can be prevented.

In a seventh aspect of the invention, the interconnects are covered by being sandwiched between two resin layers whose coefficients of thermal expansion are substantially equivalent.

In the present aspect of the invention, the interconnects connecting the piezoelectric elements and the drive ICs are covered by being sandwiched between two resin layers whose coefficients of thermal expansion are substantially equivalent. Thus, there is little occurrence of thermal stress.

In an eighth aspect of the invention, an inkjet recording device has a piezoelectric-type inkjet recording head, the inkjet recording head comprising: nozzles that jet ink droplets; pressure chambers that communicate with the nozzles and contain ink; a diaphragm that configures part of the pressure chambers; an ink pool chamber that pools ink to be supplied to the pressure chambers via ink flow paths; and piezoelectric elements that cause the diaphragm to be displaced, wherein the ink pool chamber is disposed opposite from the pressure chambers with the diaphragm being disposed therebetween, and drive ICs that apply a voltage to the piezoelectric elements are mounted on a piezoelectric element substrate formed to include the diaphragm.

DETAILED DESCRIPTION OF THE INVENTION

Figure 1:
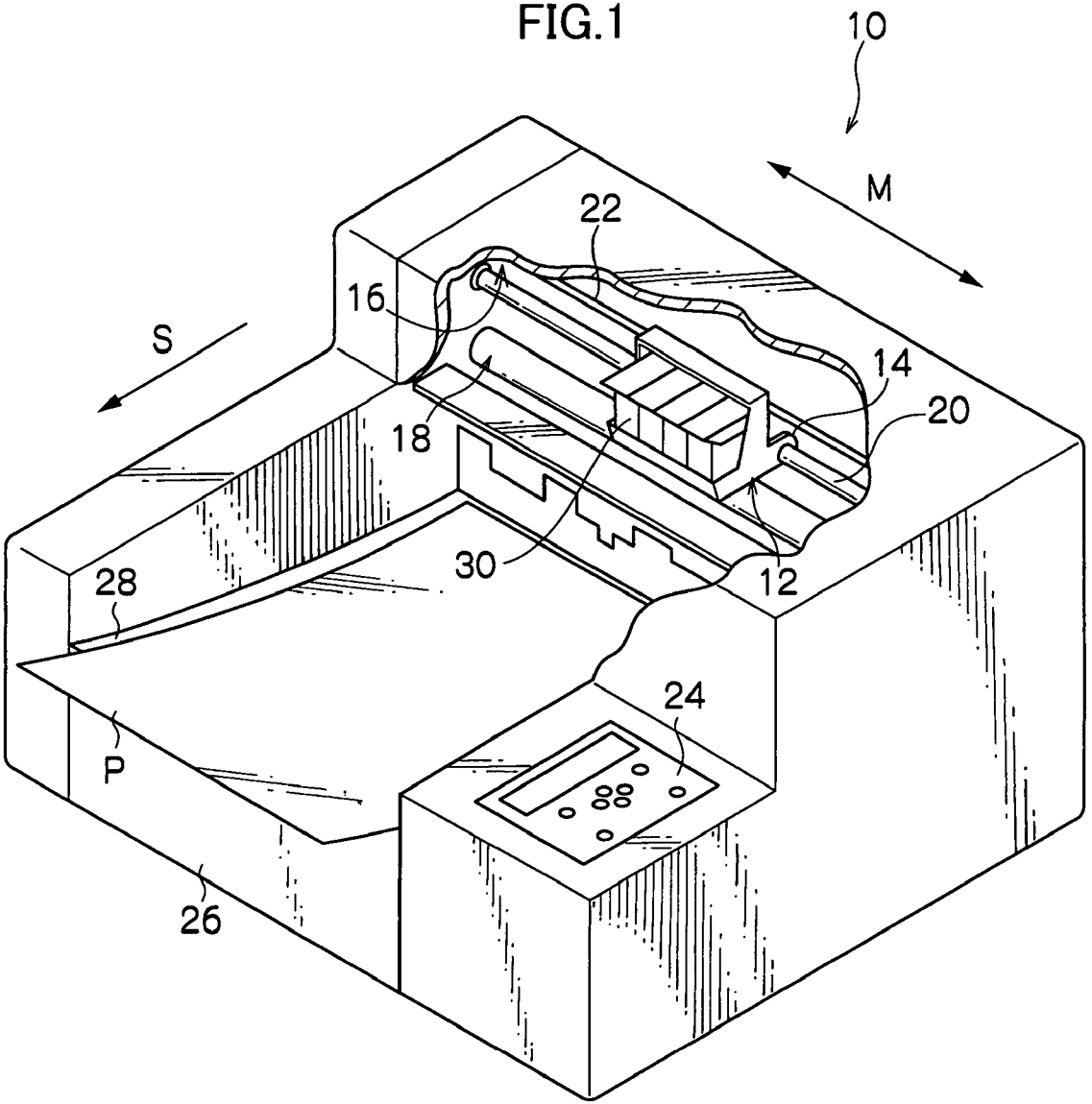
FIG. 1 is a schematic perspective diagram showing an inkjet recording device of the invention.

Embodiments of the invention will be described in detail below on the basis of examples shown in the drawings. Explanation will be conducted using recording paper P as a recording medium. Also, the conveyance direction of the recording paper P in an inkjet recording device 10 will be represented by arrow S as a sub-scanning direction, and the direction orthogonal to the conveyance direction will be represented by arrow M as a main scanning direction. Also, where an arrow UP and an arrow LO are shown in the drawings, the arrow UP will represent an upper direction and the arrow LO will represent a lower direction. When expressions indicating up and down are given, these will correspond to the aforementioned arrows.

First, the overview of the inkjet recording device 10 will be described. As shown in FIG. 1, the inkjet recording device 10 is disposed with a carriage 12 in which are loaded inkjet recording units 30 (inkjet recording heads 32) of black, yellow, magenta and cyan.

A pair of brackets 14 is disposed at an upstream side of the conveyance direction of the recording paper P, of the carriage 12. Circular holes 14A are disposed in the brackets 14 (see FIG. 2). Additionally, a shaft 20 disposed in the main scanning direction is passed through the holes 14A.

Also, a drive pulley (not shown) and a slave pulley (not shown) that configure a main scanning mechanism 16 are disposed at both end side in the main scanning direction. Part of a timing belt 22, which is wound around the drive pulley and the slave pulley and travels in the main scanning direction, is fixed to the carriage 12. Thus, the carriage 12 is supported so as to be reciprocally movable in the main scanning direction.

Also, a paper supply tray 26, into which a stack of the recording paper P is loaded prior to image printing, is disposed in the inkjet recording device 10. A paper discharge tray 28, into which is discharged the recording paper P on which an image has been printed by the inkjet recording heads 32, is disposed above the paper supply tray 26. Additionally, a sub-scanning mechanism 18, which comprises conveyance rollers and discharge rollers that convey, at a predetermined pitch and in the sub-scanning direction, the recording paper P supplied one sheet at a time from the paper supply tray 26, is disposed.

In addition, a control panel 24 for conducting various types of settings at the time of printing and a maintenance station (not shown) are disposed in the inkjet recording device 10. The maintenance station is configured by a cap member, a suction pump, a dummy jet receiver, a cleaning mechanism and the like. The maintenance station is configured to conduct maintenance operations such as suction recovery, dummy jetting and cleaning.

Figure 2:
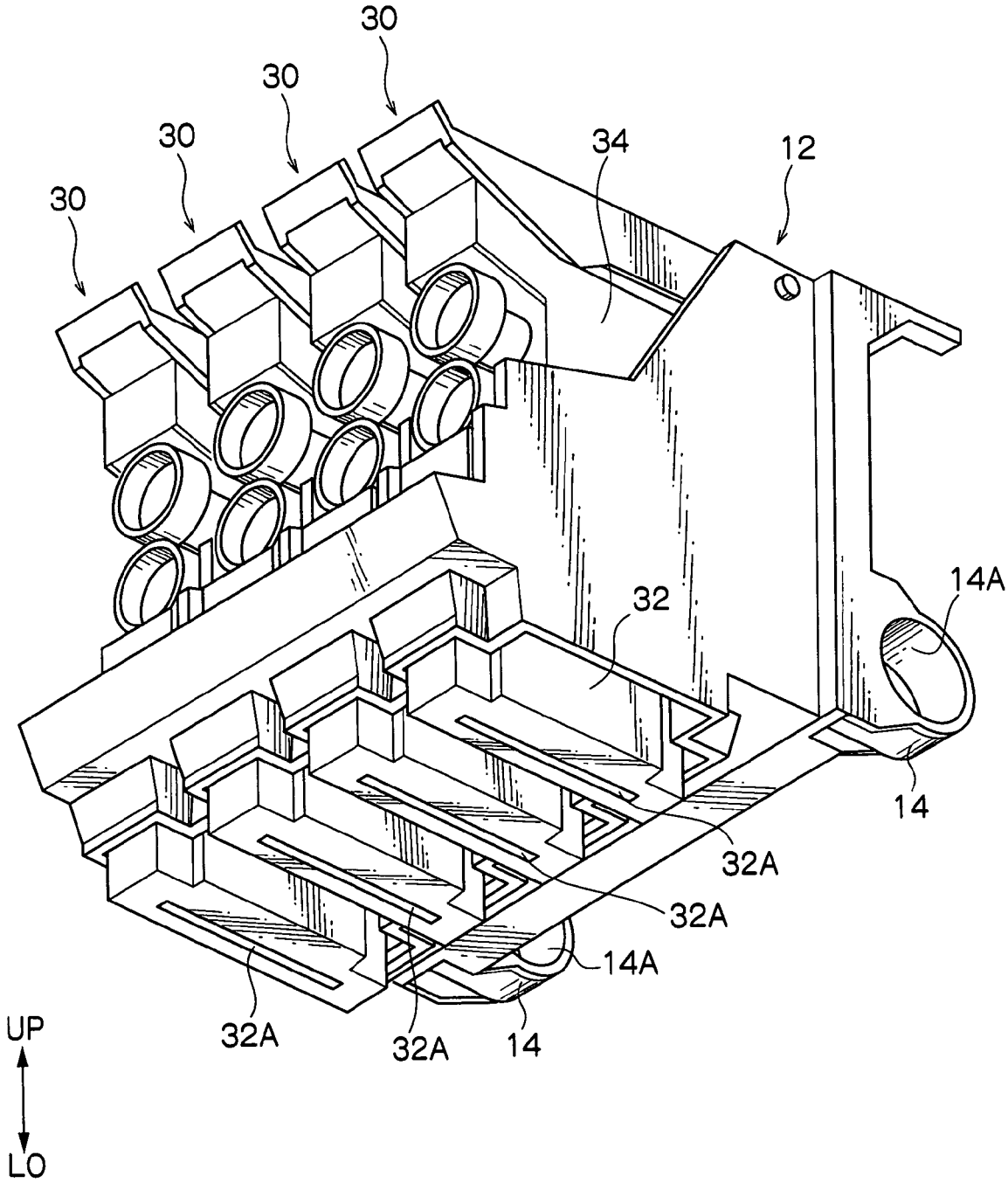
FIG. 2 is a schematic perspective diagram showing inkjet recording units loaded in a carriage.

Also, as shown in FIG. 2, the inkjet recording units 30 of each color are units where the inkjet recording heads 32 and ink tanks 34, which supply ink to the inkjet recording heads 32, are integrated. Plural nozzles 56 (see FIG. 3) formed in inkjet surfaces 32A in the centers of lower surfaces of the inkjet recording heads 32 are disposed on the carriage 12 so as to face the recording paper P.

Thus, ink droplets are selectively jetted from the nozzles 56 with respect to the recording paper P while the inkjet recording heads 32 are moved by the main scanning mechanism 16 in the main scanning direction, whereby part of an image based on image data is recorded with respect toga predetermined band region.

Then, when one-time movement in the main scanning direction ends, the recording paper P is conveyed at a predetermined pitch in the sub-scanning direction by the sub-scanning mechanism 18, and the inkjet recording heads 32 (inkjet recording units 30) are again moved in the main scanning direction (the opposite direction from before), whereby part of the image based on image data is recorded with respect to the next band region. By repeating this operation several times, an entire image based on image data is recorded in full color on the recording paper P.

Figure 3:
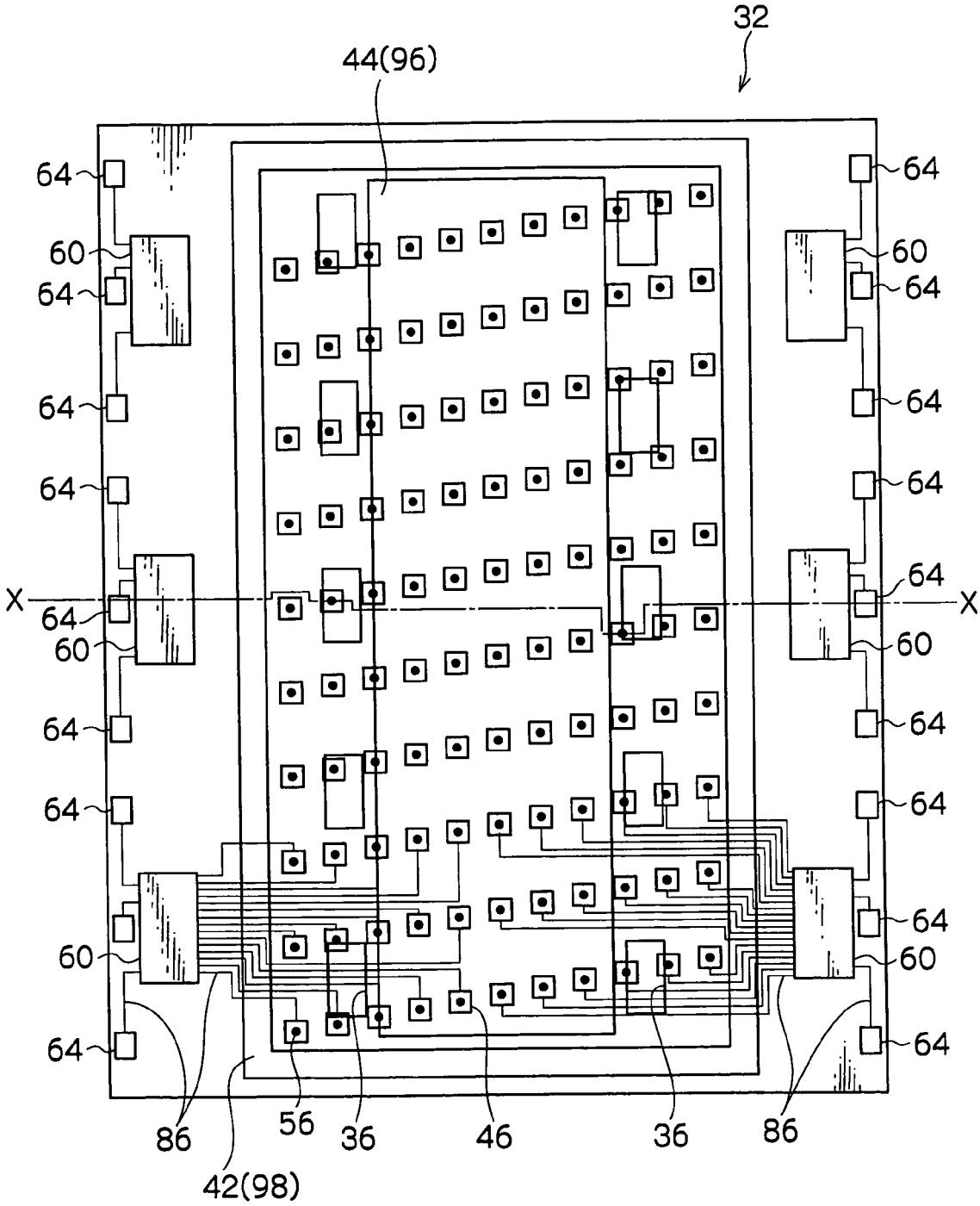
FIG. 3 is a schematic plan diagram showing the configuration of an inkjet recording head.
Figure 4:
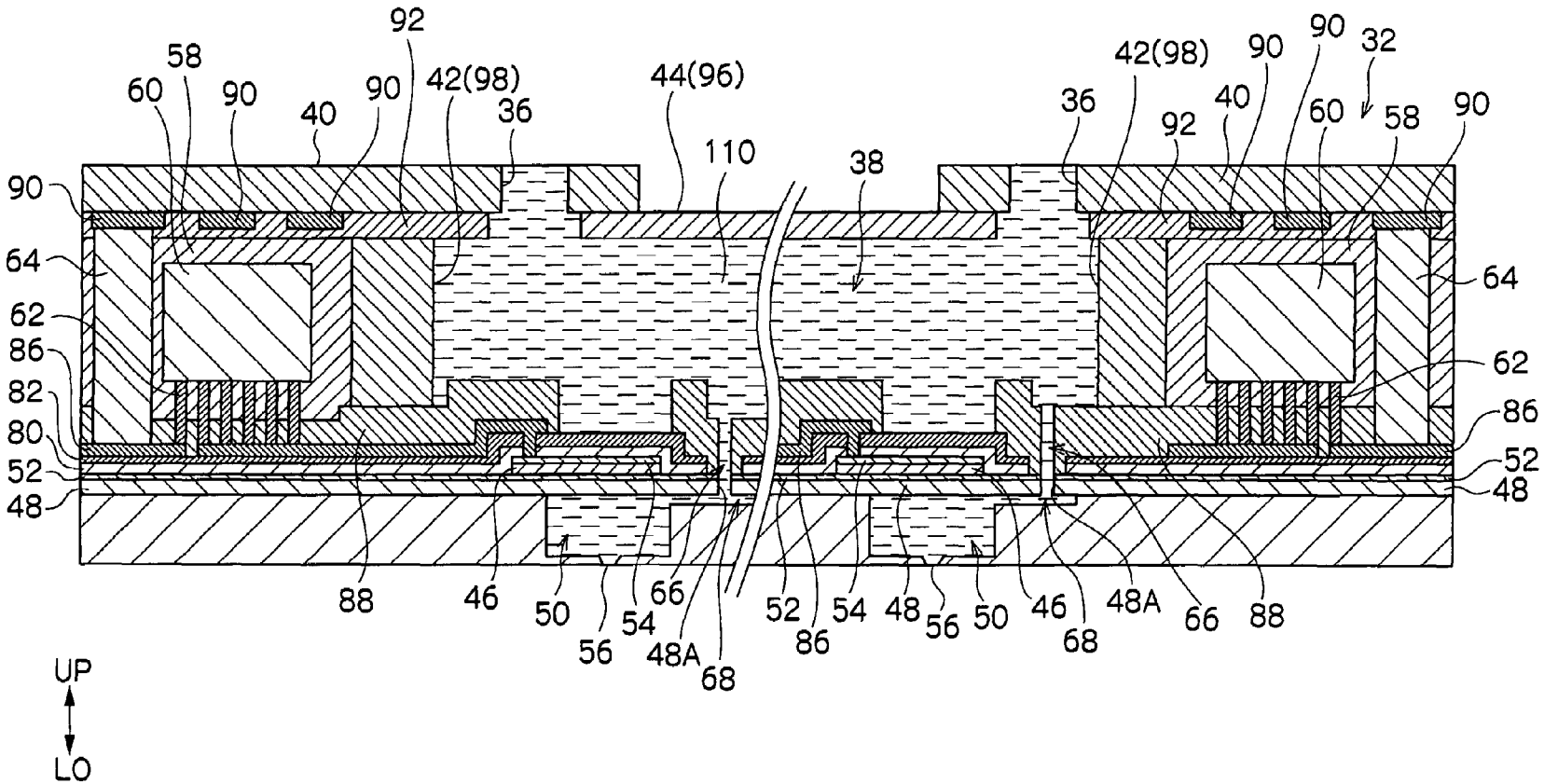
FIG. 4 is a schematic cross-sectional diagram along line X-X of FIG. 3.

Next, the inkjet recording heads 32 in the inkjet recording device 10 of the above configuration will be described in detail. FIG. 3 is a schematic plan diagram showing the configuration of the inkjet recording heads 32, and FIG. 4 is a schematic cross-sectional diagram along line X-X of FIG. 3. As shown in FIGS. 3 and 4, ink supply ports 36 that communicate with the ink tank 34 are disposed in each inkjet recording head 32. Ink 110 that is injected from the ink supply ports 36 is retained in an ink pool chamber 38.

The volume of the ink pool chamber 38 is determined by a top plate 40 and a partition wall 42. The ink supply ports 36 are plurally punched in rows at predetermined places in the top plate 40. A resin film-made air damper 44 (a later-described photosensitive dry film 96) that alleviates pressure waves is disposed further inside the ink pool chamber 38 than the top plate 40 and between the ink supply ports 36 forming the rows.

Any material may be used for the top plate 40 as long as it is an insulator having strength sufficient enough to serve as a support for the inkjet recording head 32, such as glass, ceramic, silicon or resin. Also, metal interconnects (wiring) 90 for supplying electricity to later-described drive ICs 60 are disposed in the top plate 40. The metal interconnects 90 are covered and protected by a resin film 92, whereby erosion resulting from the ink 110 is prevented.

The partition wall 42 is formed by resin (a later-described photosensitive dry film 98) and partitions the ink pool chamber 38 in a rectangular shape. Also, the ink pool chamber 38 is vertically separated from pressure chambers 50 via piezoelectric elements 46 and a diaphragm 48 that is flexibly deformed in the vertical direction by the piezoelectric elements 46. In other words, the piezoelectric elements 46 and the diaphragm 48 are disposed between the ink pool chamber 38 and the pressure chambers 50, so that the ink pool chamber 38 and the pressure chambers 50 do not exist in the same horizontal plane.

Thus, it is possible to dispose the pressure chambers 50 in a state where they are mutually proximate, and it becomes possible to dispose the nozzles 56 in a matrix in a high density. Also, by configuring the inkjet recording head 32 in this manner, an image can be formed in a wide band region by a one movement of the carriage 12 in the main scanning direction, so that the scanning time is short. Namely, high-speed printing where image formation is conducted across the entire surface of the recording paper P with a few number of movements of the carriage 12 and in little time becomes realizable.

The piezoelectric elements 46 are adhered to the upper surface of the diaphragm 48 for each pressure chamber 50. The diaphragm 48 is formed by a metal such as SUS, includes elasticity at least in the vertical direction, and is elastically deformed (displaced) in the vertical direction when charged by the piezoelectric element 46 (i.e., when voltage is applied thereto). It should be noted that the diaphragm 48 may be made of an insulating material such as glass.

A lower electrode 52 having one polarity is disposed at the lower surfaces of the piezoelectric elements 46, and an upper electrode 54 having the other polarity is disposed at the upper surfaces of the piezoelectric elements 46. Additionally, the upper electrode 54 and the drive ICs 60 are electrically connected by metal interconnects 86.

Also, the piezoelectric elements 46 are covered and protected by a low-moisture-permeability insulating film ($SiO_x$ film) 80. The low-moisture-permeability insulating film ($SiO_x$ film) 80 covering and protecting the piezoelectric elements 46 are adhered under the condition that moisture permeability thereof becomes low, whereby moisture can be prevented from penetrating the insides of the piezoelectric elements 46 and causing the reliability of the piezoelectric elements 46 to deteriorate (i.e., moisture can be prevented from reducing oxygen inside the PZT film and causing deterioration of piezoelectric characteristics). The diaphragm 48 made of metal (SUS, etc.) contacting the lower electrode 52 functions as low-resistance GND interconnects.

Moreover, the upper surface of the low-moisture-permeability insulating film ($SiO_x$ film) 80 is covered and protected by a resin film 82. Thus, with respect to the piezoelectric elements 46, resistance to erosion resulting from the ink 110 is ensured. Also, the metal interconnects 86 are also covered and protected by a resin protective film 88, whereby erosion resulting from the ink 110 is prevented.

Upper surfaces of the piezoelectric elements 46 are covered and protected by the resin film 82 and not covered by the resin protective film 88. The resin film 82 is a resin layer having flexibility, and due to this configuration, inhibition of the displacement of the piezoelectric elements 46 (the diaphragm 48) is prevented (i.e., it is ensured that the piezoelectric elements 46 are flexibly deformable in the vertical direction). In other words, the upper surfaces of the piezoelectric elements 46 are not covered by the resin protective film 88, because the more thinner the resin film above the piezoelectric elements 46 is, the less it causes the displacement of the piezoelectric elements 46.

The drive ICs 60 are disposed, at the outer side of the ink pool chamber 38 regulated by the partition wall 42, between the top plate 40 and the diaphragm 48 and are not exposed (do not project) from the diaphragm 48 and the top plate 40. Thus, miniaturization of the inkjet recording head 32 becomes realizable.

Figure 5:
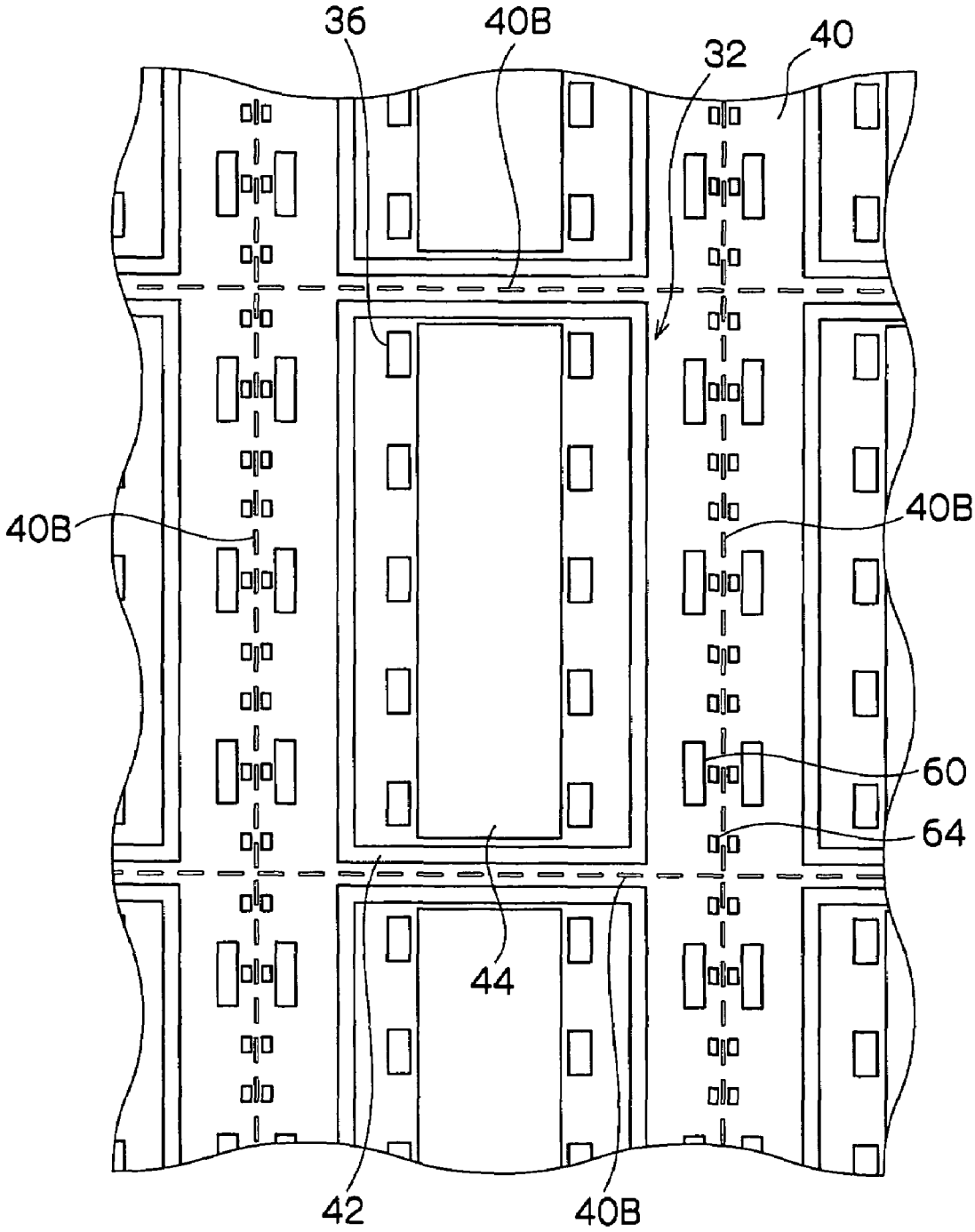
FIG. 5 is a schematic plan diagram showing a top plate before being cut as inkjet recording heads.

Also, the peripheries of the drive ICs 60 are sealed with a resin material 58. As shown in FIG. 5, inlets 40B for the resin material 58 sealing the drive ICs 60 are plurally disposed in a grid manner so as to partition each inkjet recording head 32 in the top plate 40 at the stage of production. After a later-described piezoelectric element substrate 70 and flow path substrate 72 have been coupled (bonded) together, the top plate 40 is cut along the inlets 40B sealed (blocked) by the resin material 58, whereby the inkjet recording heads 32 including the nozzles 56 in the matrix (see FIG. 3) can be plurally produced at one time.

Figure 6:
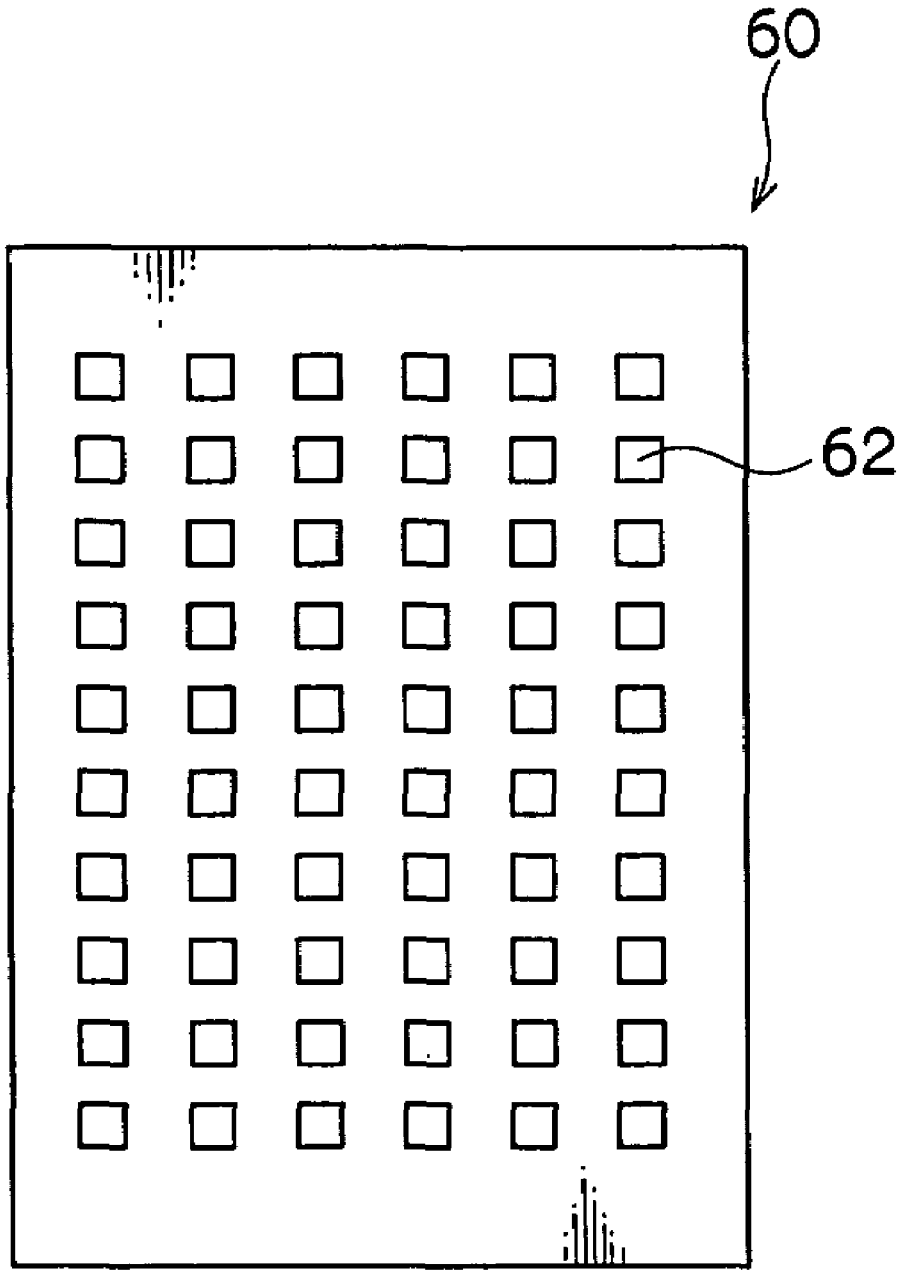
FIG. 6 is a schematic plan diagram showing bumps of a drive IC.

Also, as shown in FIGS. 4 and 6, plural bumps 62 protrude to a predetermined height in a matrix from the lower surfaces of the drive ICs 60, and these are flip-chip-mounted to the metal interconnects 86 of the piezoelectric element substrate 70 where the piezoelectric elements 46 are formed on the diaphragm 48. Thus, high-density connection with respect to the piezoelectric elements 46 is easily realizable, and the height of the drive ICs 60 can be reduced (can be thinned). Thus, miniaturization of the inkjet recording head 32 becomes realizable.

Also, as shown in FIG. 3, bumps 64 are also disposed on the outer side of the drive ICs 60. The bumps 64 connect the metal interconnects 90 disposed on the top plate 40 and the metal interconnects 86 disposed on the piezoelectric element substrate 70. Of course, the bumps 64 are disposed to be higher than the height of the drive ICs 60 mounted on the piezoelectric element substrate 70.

Thus, electricity is supplied to the metal interconnects 90 of the top plate 40 from the main body side of the inkjet recording device 10, electricity is then supplied to the metal interconnects 86 from the metal interconnects 90 of the top plate 40 via the bumps 64, and from there electricity is supplied to the drive ICs 60. Additionally, a voltage is applied at a predetermined timing to the piezoelectric elements 46 by the drive IDs 60, and the diaphragm 48 is flexibly deformed in the vertical direction, whereby the ink 110 in the pressure chambers 50 is pressurized and the ink droplets are jetted from the nozzles 56.

As for the nozzles 56 that jet the ink droplets, one is disposed for each pressure chamber 50 at a predetermined position thereof. The pressure chambers 50 and the ink pool chamber 38 avoid the piezoelectric elements 46 and are connected because ink flow paths 66 passing through through-holes 48A disposed in the diaphragm 48 communicate with ink flow paths 68 provided from the pressure chambers 50 in the horizontal direction in FIG. 4. The ink flow paths 68 are provided to extend slightly longer than the portions that connect with the actual ink flow paths 66 so that alignment with the ink flow paths 66 is possible (so that they reliably communicate with each other) at the time of producing the inkjet recording heads 32.

Figure 7:
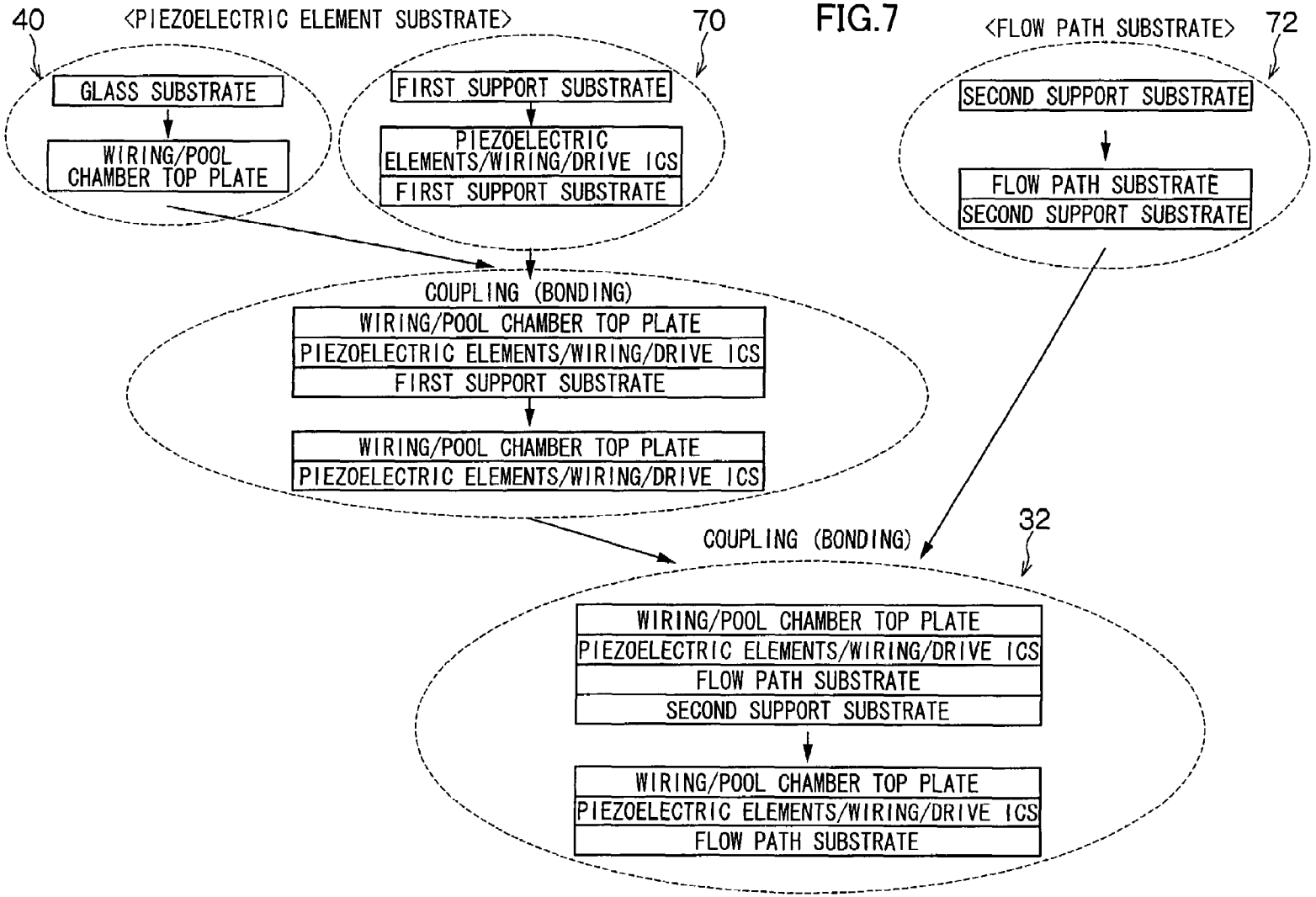
FIG. 7 is an explanatory diagram of an overall process for producing the inkjet recording head.

Next, the process of producing the inkjet recording heads 32 of the above configuration will be described in detail on the basis of FIGS. 7 to 13A and 13B. As shown in FIG. 7, each inkjet recording head 32 is produced by separately making the piezoelectric element substrate 70 and the flow path substrate 70 and then coupling (bonding) both together. First, the process of producing the piezoelectric element substrate 70 will be described. The top plate 40 is coupled (bonded), before the flow path substrate 70, to the piezoelectric element substrate 70.

Figures 8A, 8B, 8C, 8D, 8E, 8F:
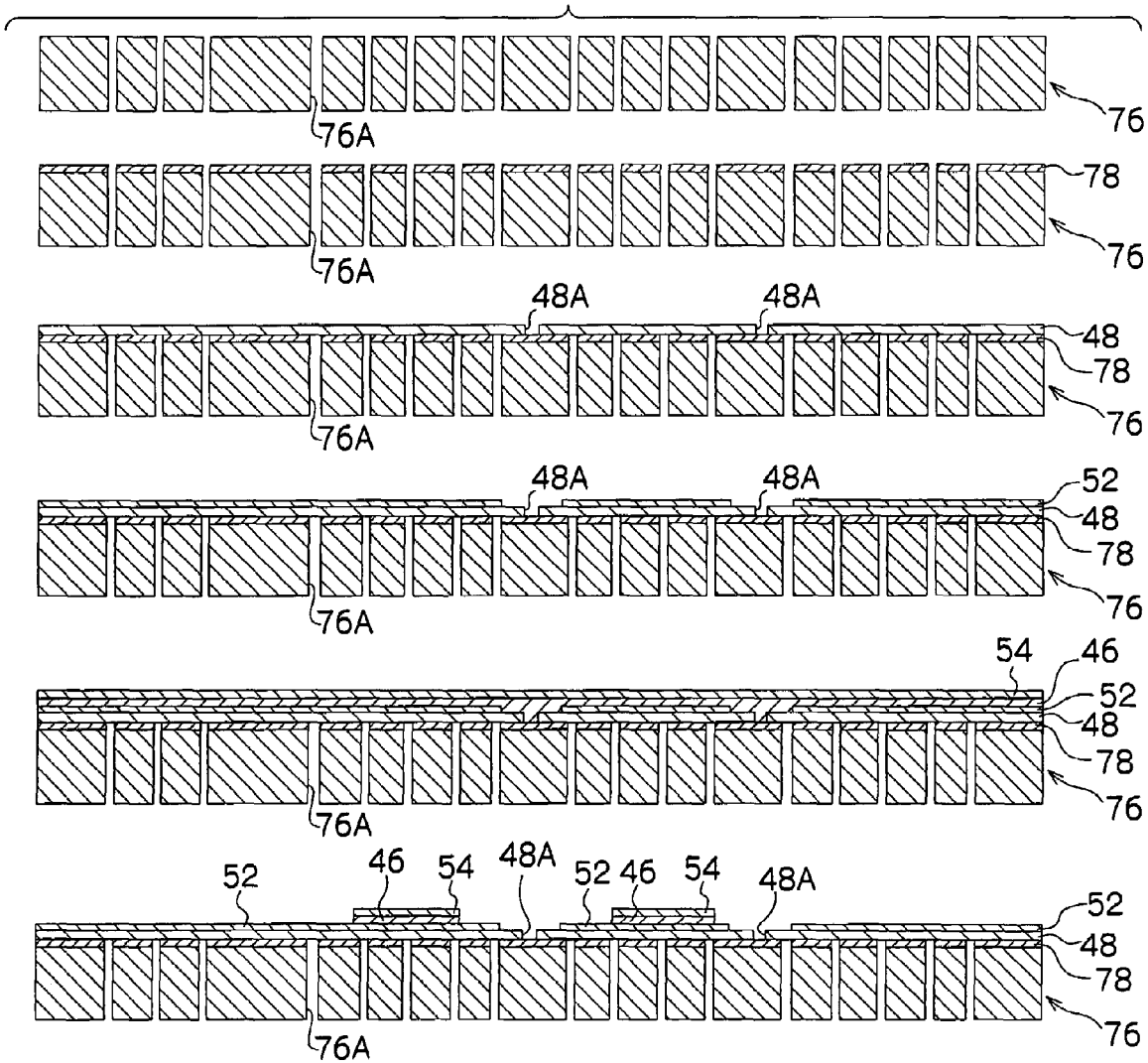
FIGS. 8A to 8J are explanatory diagrams showing processes for producing a piezoelectric element substrate.

As shown in FIG. 8A, a first support substrate 76 that is made of glass and disposed with plural through-holes 76A is prepared. Any material may be used for the first support substrate 76 as long as it is a material that does not bend; this material is not limited to glass, but glass is preferable because it is hard and inexpensive. As the method of producing the first support substrate 76, femtosecond laser processing of a glass substrate and exposing/developing a photosensitive glass substrate (e.g., PEG3C produced by HOYA Co., Ltd.) are known.

Then, as shown in FIG. 8B, an adhesive 78 is applied to the upper surface of the first support substrate 76, and as shown in FIG. 8C, the diaphragm 48 made of metal (SUS, etc.) is adhered to the upper surface of the adhesive 78. At this time, it is ensured that the through-holes 48A in the diaphragm 48 do not overlap the through-holes 76A in the first support substrate 76. An insulating substrate such as glass may be used for the material of the diaphragm 48.

Here, the through-holes 48A in the diaphragm 48 serve in the formation of the ink flow paths 66. Also, the reason the through-holes 76A are disposed in the first support substrate 76 is because a chemical (solvent) is poured in the interface between the first support substrate 76 and the diaphragm 48 to dissolve the adhesive 78 and separate the first support substrate 76 from the diaphragm 48. Moreover, the reason it is ensured that the through-holes 76A in the first support substrate 76 do not overlap the through-holes 48A in the diaphragm 48 is to ensure that the various types of materials used during production do not leak from the lower surface (bottom surface) of the first support substrate 76.

Next, as shown in FIG. 8D, the lower electrode 52 laminated on the upper surface of the diaphragm 48 is patterned. Specifically, this is done by sputtering a metal film (film thickness of 500 Å to 3000 Å), forming a resist by photolithography, patterning (etching) the metal film, and separating the resist with oxygen plasma. The lower electrode 52 has a ground potential.

Next, as shown in FIG. 8E, a PZT film, which is the material of the piezoelectric element 46, and the upper electrode 54 are sequentially laminated on the upper surface of the lower electrode 52 by sputtering, and as shown in FIG. 8F, the piezoelectric element 46 (PZT film) and the upper electrode 54 are patterned.

Specifically, this is done by sputtering a PZT film (film thickness of 3 μm to 15 μm), sputtering a metal film (film thickness of 500 Å to 3000 Å), forming a resist by photolithography, patterning (etching) the metal film, and separating the resist with oxygen plasma. Examples of the materials for the lower and upper electrodes include Au, Ir, Ru and Pt, whose affinity with the PZT material that is the piezoelectric element is high and which have heat resistance.

Figure 8G:
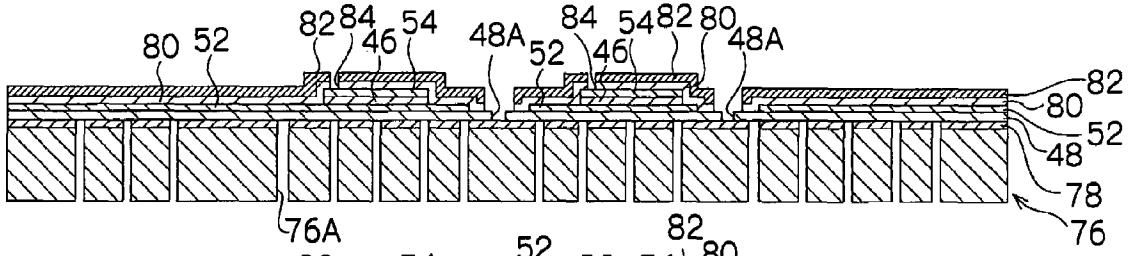

Thereafter, as shown in FIG. 8G, the low-moisture-permeability insulating film ($SiO_x$ film) 80 is laminated on the upper surfaces of the lower electrode 52 and the upper electrode 54 exposed at the upper surface. Moreover, the resin film 82 that has ink resistance and flexibility—e.g., a polyimide, polyamide, epoxy, polyurethane or silicon resin film—is laminated on the upper surface of the low-moisture-permeability insulating film ($SiO_x$ film) 80 and these are patterned, whereby holes 84 (contact holes) are formed for connecting the piezoelectric element 46 and the metal interconnects 86.

Specifically, a process is conducted where the low-moisture-permeability insulating film ($SiO_x$ film) 80, whose dangling bond density is high, is adhered by Chemical Vapor Deposition (CVD), patterning is conducted by applying/exposing/developing photosensitive polyimide (e.g., the photosensitive polyimide Durimide 7520 produced by Fuji Film Arch Co., Ltd.), and the $SiO_x$ film is etched using the photosensitive polyimide as a mask by Reactive Ion Etching (RIE) using $CF_4$ gas. Here, an $SiO_x$ film is used as the low-moisture-permeability insulating film, but $SiN_x$ or $SiO_xN_y$ may also be used.

Figure 8H:
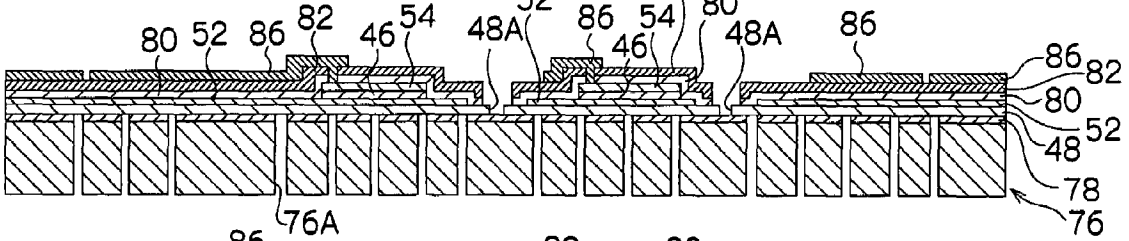

Next, as shown in FIG. 8H, a metal film is laminated on the upper surface of the resin film 82 and the upper electrode 54 inside the holes 84, and the metal interconnects 86 are patterned. Specifically, a process is conducted where an Al film (thickness of 1 μm) is adhered by sputtering, a resist is formed by photolithography, the Al film is etched by RIE using chlorine gas, and the resist film is separated with oxygen plasma. Then the upper electrode 54 and the metal interconnects 86 (Al film) are bonded together.

Although not illustrated, the holes 84 are also disposed above the lower electrode 52 so that, similar to the upper electrode 54, they are connected with the metal interconnects 86.

Figure 8I:
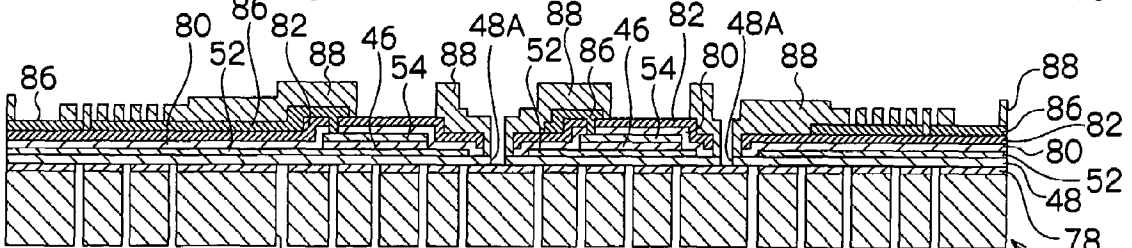

Moreover, as shown in FIG. 8I, the resin protective film 88 (e.g., the photosensitive polyimide Durimide 7320 produced by Fuji Film Arch Co., Ltd.) is laminated on the upper surfaces of the metal interconnects 86 and the resin film 82, and patterned. The resin protective film 88 is configured by the same type of resin material as the resin film 82. Also, at this time, it is ensured that the resin protective film 88 is not laminated on sites above the piezoelectric element 46 where the metal interconnects 86 are not patterned (so that only the resin film 82 is laminated on the low-moisture-permeability insulating film ($SiO_x$ film) 80).

Here, the reason the resin protective film 88 is not laminated above the piezoelectric element 46 (on the upper surface of the resin film 82) is to prevent the displacement (flexible deformation in the vertical direction) of the diaphragm 48 (the piezoelectric element 46) from being inhibited.

Also, when the metal interconnects 86 pulled out from the upper electrode 54 (for connecting to the upper electrode 54) of the piezoelectric element 46 are covered by the resin protective film 88, the bonding strength of the resin films covering the metal interconnects 86 becomes strong and corrosion of the metal interconnects 86 resulting from penetration of the ink 110 from the interface can be prevented because the resin protective film 88 is configured by the same type of resin material as the resin film 82 on which the metal interconnects 86 are laminated.

Because the resin protective film 88 is also made of the same type of resin material as the partition wall 42 (photosensitive dry film 98), the bonding strength with respect to the partition wall 42 (photosensitive dry film 98) also becomes strong. Thus, the penetration of the ink 110 from that interface can be more reliably prevented. Also, when these members are configured by the same type of resin material, the coefficients of thermal expansion of these become substantially equivalent, so that there is also the advantage that there is little occurrence of heat stress.

Figure 8J:
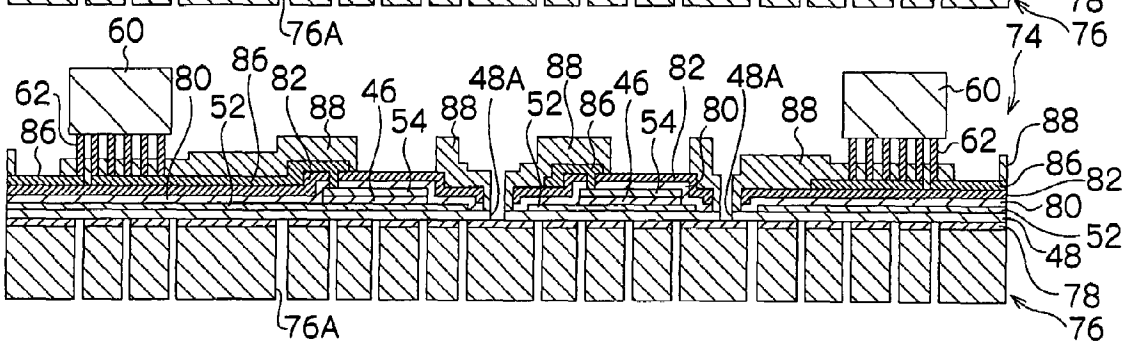

Next, as shown in FIG. 8J, the drive ICs 60 are flip-chip-mounted on the metal interconnects 86 via the bumps 62. At this time, the drive ICs 60 are processed to a predetermined thickness (70 μm to 300 μm) by grinding implemented at the end of a semiconductor wafer process. When the drive ICs 60 are too thick, the patterning of the partition wall 42 and the formation of bumps 64 become difficult.

Electrolytic plating, non-electrolytic plating, ball bump and screen printing can be applied for the method of forming the bumps 62 for flip-chip-mounting the drive ICs 60 to the metal interconnects 86. In this manner, the piezoelectric element substrate 70 is produced, and the top plate 40 made of, for example, glass is coupled (bonded) to the piezoelectric element substrate 70. It should be noted that in FIGS. 9A to 9H below, the interconnects forming surface will be described as a lower surface for convenience of explanation, but the interconnects forming surface is an upper surface in the actual process.

Figures 9A, 9B, 9C, 9D:
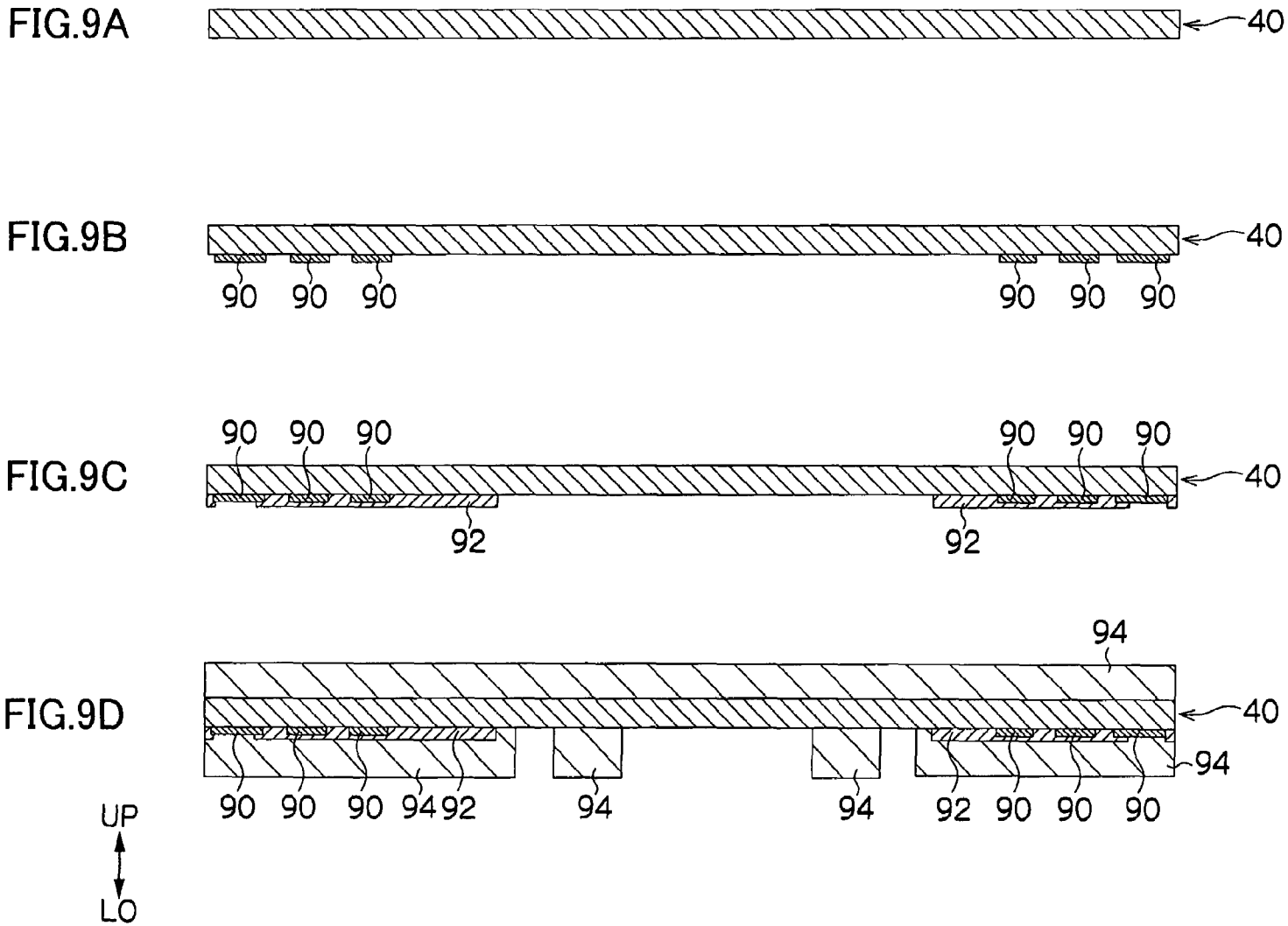
FIGS. 9A to 9H are explanatory diagrams showing processes for producing a top plate.

With respect to the production of the glass top plate 40, as shown in FIG. 9A, it is not necessary to separately dispose a support because the top plate 40 itself has a thickness (0.3 mm to 1.5 mm) with which strength sufficient for the top plate 40 to serve as a support can be ensured.

First, as shown in FIG. 9B, the metal interconnects 90 are laminated on the lower surface of the top plate 40 and patterned. Specifically, this is done by adhering an Al film (thickness of 1 μm) by sputtering, forming a resist by photolithography, etching the Al film by RIE using chlorine gas, and separating the resist with oxygen plasma.

Then, as shown in FIG. 9C, the resin film 92 (e.g., the photosensitive polyimide Durimide 7320 produced by Fuji Film Arch Co., Ltd.) is laminated on the surface on which the metal interconnects 90 are formed, and the resin film 92 is patterned. At this time, it is ensured that the resin film 92 is not laminated on some of the metal interconnects 90 because the bumps 64 are bonded to these portions.

Next, as shown in FIG. 9D, a resist is patterned by photolithography on the surface of the top plate 40 on which the metal interconnects 90 are formed. The surface of the top plate 40 on which the metal interconnects 90 are not formed is entirely covered with a protective resist 94. Here, the reason the protective resist 94 is applied is to prevent the top plate 40 from being etched, in the next wet ($SiO_2$) etching process, from the back surface of the surface on which the metal interconnects 90 are formed. In a case where a photosensitive glass substrate is used for the top plate 40, the process of applying the protective resist 94 can be omitted.

Figures 9E, 9F, 9G, 9H:
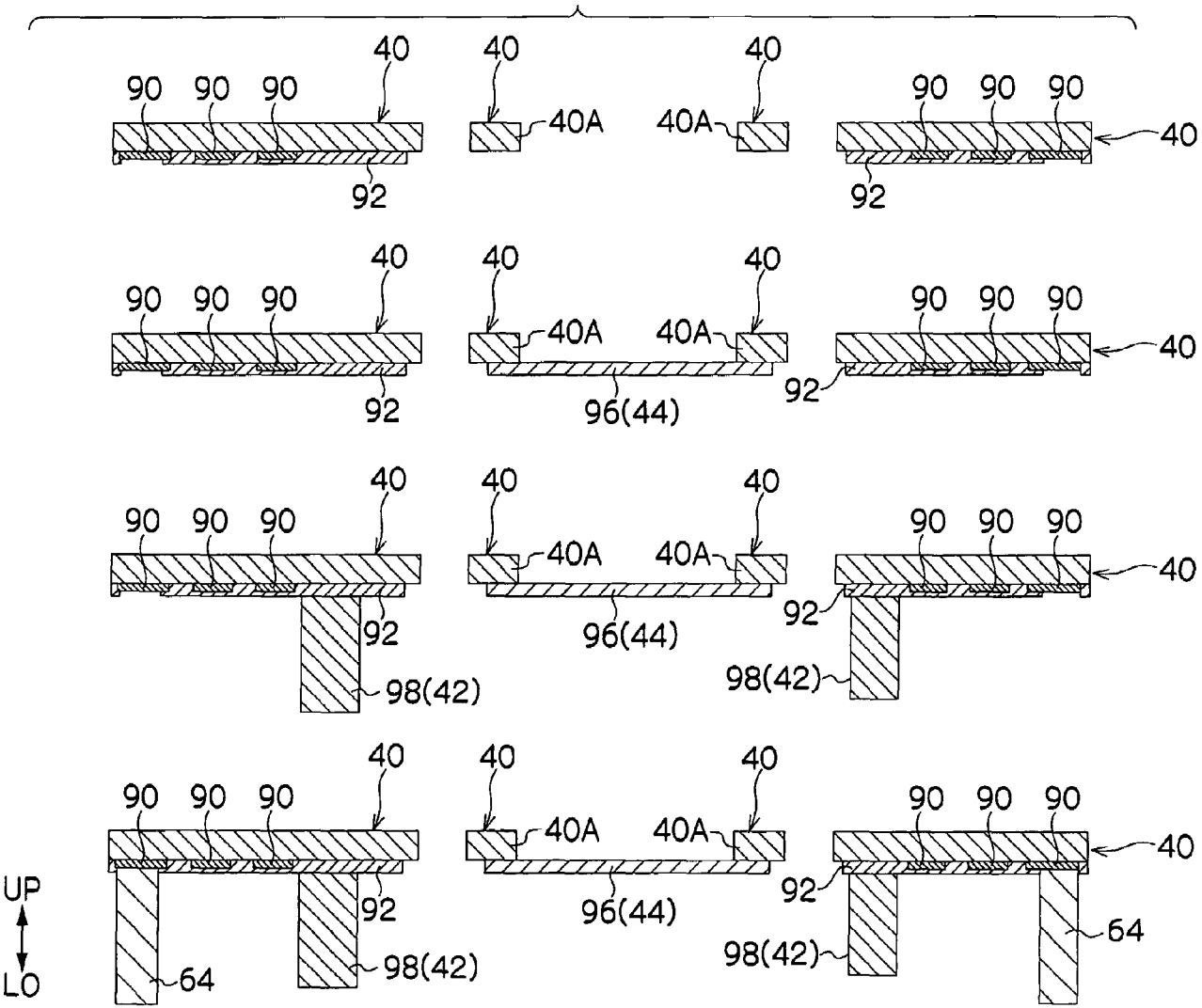

Next, as shown in FIG. 9E, wet ($SiO_2$) etching with an HF solvent is conducted with respect to the top plate 40, and thereafter the protective resist 94 is separated with oxygen plasma. Then, as shown in FIG. 9F, the portions of the holes 40A formed in the top plate 40 are each provided with the photosensitive dry film 96, such that the photosensitive dry film 96 is suspended therefrom, by exposing/developing a photosensitive dry film (e.g., Raytec FR-5025 produced by Hitachi Chemical Co., Ltd.; thickness of 25 μm) in a patterned configuration. This photosensitive dry film 96 becomes the air damper 44 that alleviates pressure waves.

Next, as shown in FIG. 9G, the photosensitive dry film 98 (thickness of 100 μm) is laminated on the resin film 92 and patterned by exposure/development. This photosensitive dry film 96 becomes the partition wall 42 regulating the ink pool chamber 38. It should be noted that the partition wall 42 is not limited to the photosensitive dry film 98 and may be a resin coating film (e.g., the SU-8 resist produced by Kayaku Micro-Chem. Co.). In this case, the resin coating film may be applied with a spay coater and exposed/developed.

Finally, as shown in FIG. 9H, the bumps 64 are formed by plating on the metal interconnects 90 on which the resin film 92 has not been laminated. Because the bumps 64 are electrically connected to the metal interconnects 86 of the drive ICs 60, the bumps 64 are formed so that, as is illustrated, their height is higher than that of the photosensitive dry film 98 (partition wall 42).

Figure 10A:
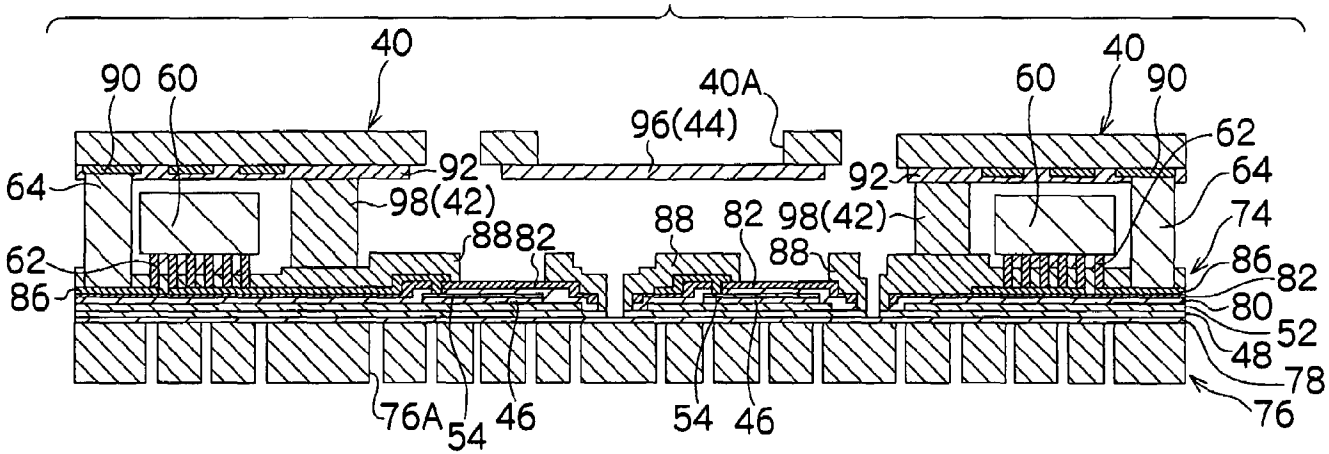
FIGS. 10A to 10D are explanatory diagrams showing processes for bonding the top plate to the piezoelectric element substrate.

In this manner, when the production of the top plate 40 is finished, the top plate 40 is disposed on the piezoelectric element substrate 70 as shown in FIG. 10A, and both are coupled (bonded) together by thermocompression. Namely, the photosensitive dry film 98 (the partition wall 42) is bonded to the resin protective film 88, which is a photosensitive resin layer, and the bumps 64 are bonded to the metal interconnects 86.

At this time, because the height of the bumps 64 is higher than the height of the photosensitive dry film (partition wall 42), the photosensitive dry film 98 (partition wall 42) is bonded to the resin protective film 88, whereby the bumps 64 are automatically bonded to the metal interconnects 86. In other words, because it is easy to adjust the height of the solder bumps 64 (because they are easy to collapse), the sealing of the ink pool chamber 38 with the photosensitive dry film 98 (partition wall 42) and the connection of the bumps 64 can be done easily.

Figure 10B:
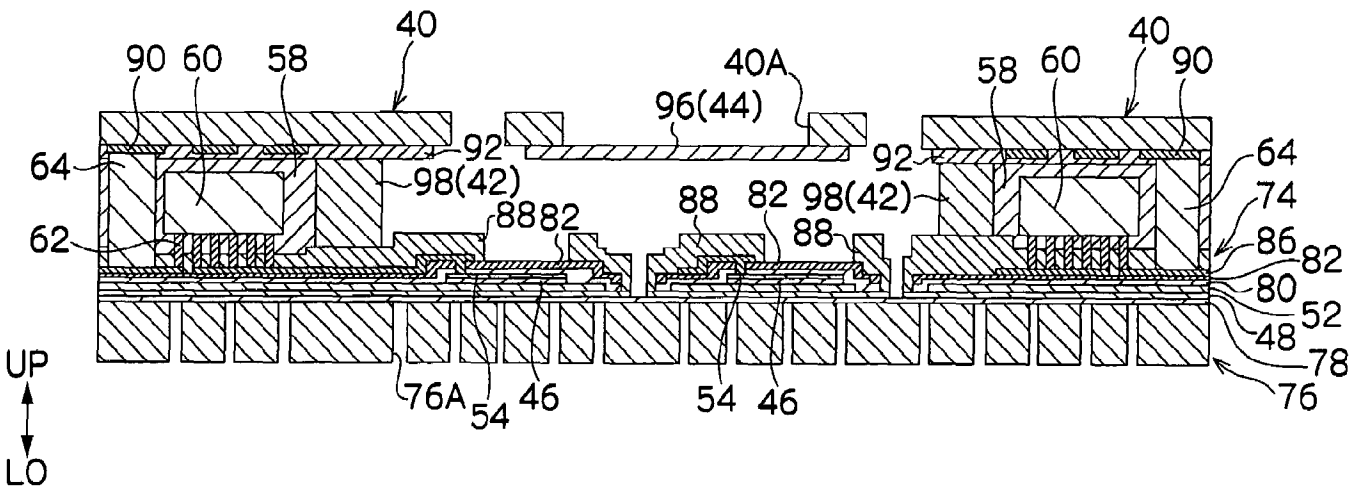

When the bonding of the partition wall 42 and the bumps 64 is finished, as shown in FIG. 10B, the sealing resin material 58 (e.g., epoxy resin) is injected in the drive ICs 60. Namely, the resin material 58 is poured through the inlets 40B (see FIG. 5) disposed in the top plate 40.

When the resin material 58 is injected and the drive ICs 60 are sealed in this manner, the drive ICs 60 can be protected from the external environment such as moisture, the adhesive strength between the piezoelectric element substrate 70 and the top plate 40 can be improved, and damage during later processes—e.g., damage resulting from moisture and grinded pieces when the finished piezoelectric element substrate 70 is separated into the inkjet recording heads 32 by dicing—can be avoided.

Figure 10C:
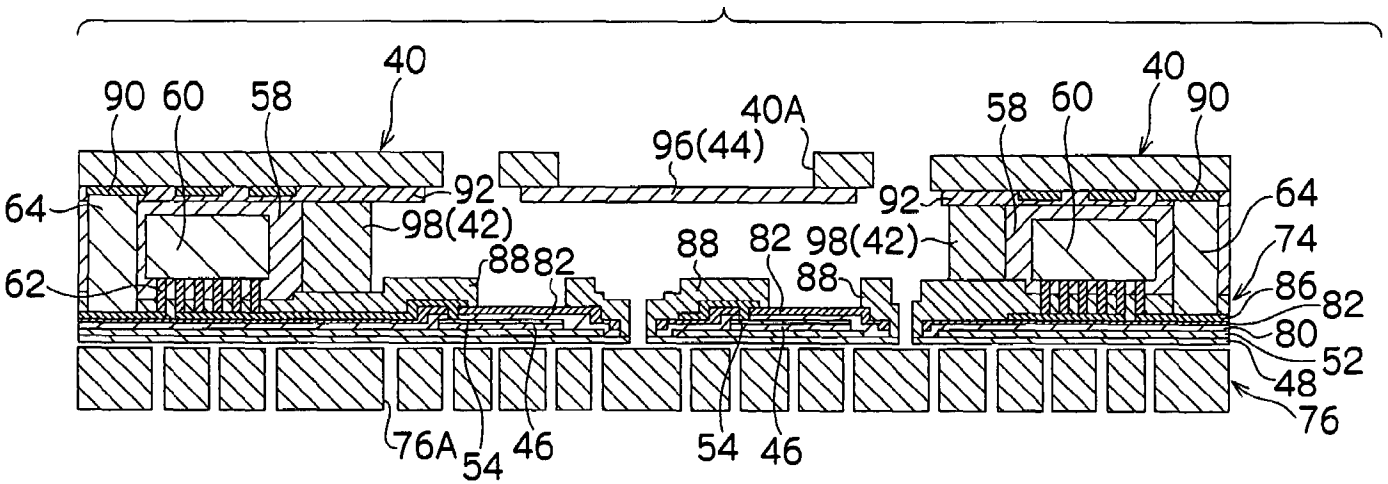
Figure 10D:
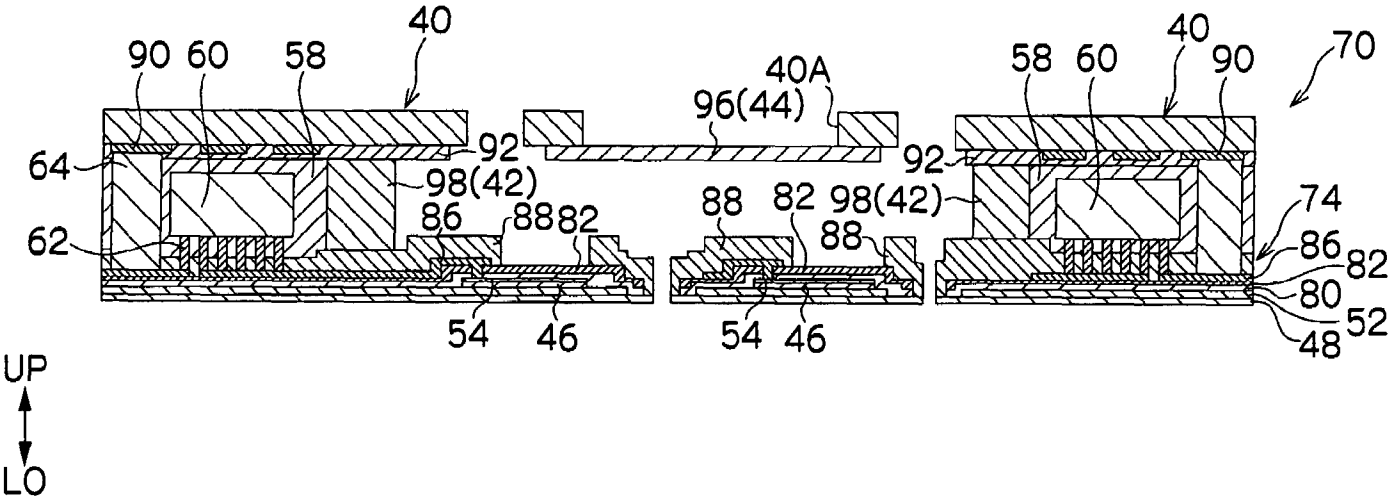

Next, as shown in FIG. 10C, an adhesive separating solvent is injected through the through-holes 76A in the first support substrate 76 to selectively dissolve the adhesive 78, whereby the first support substrate 76 is separated from the piezoelectric element substrate 70. Thus, as shown in FIG. 10D, the piezoelectric element substrate 70, to which the top plate 40 is coupled (bonded), is completed. Then, from this state, the top plate 40 serves as a support for the piezoelectric element substrate 70.

Figures 11A, 11B, 11C, 11D, 11E:
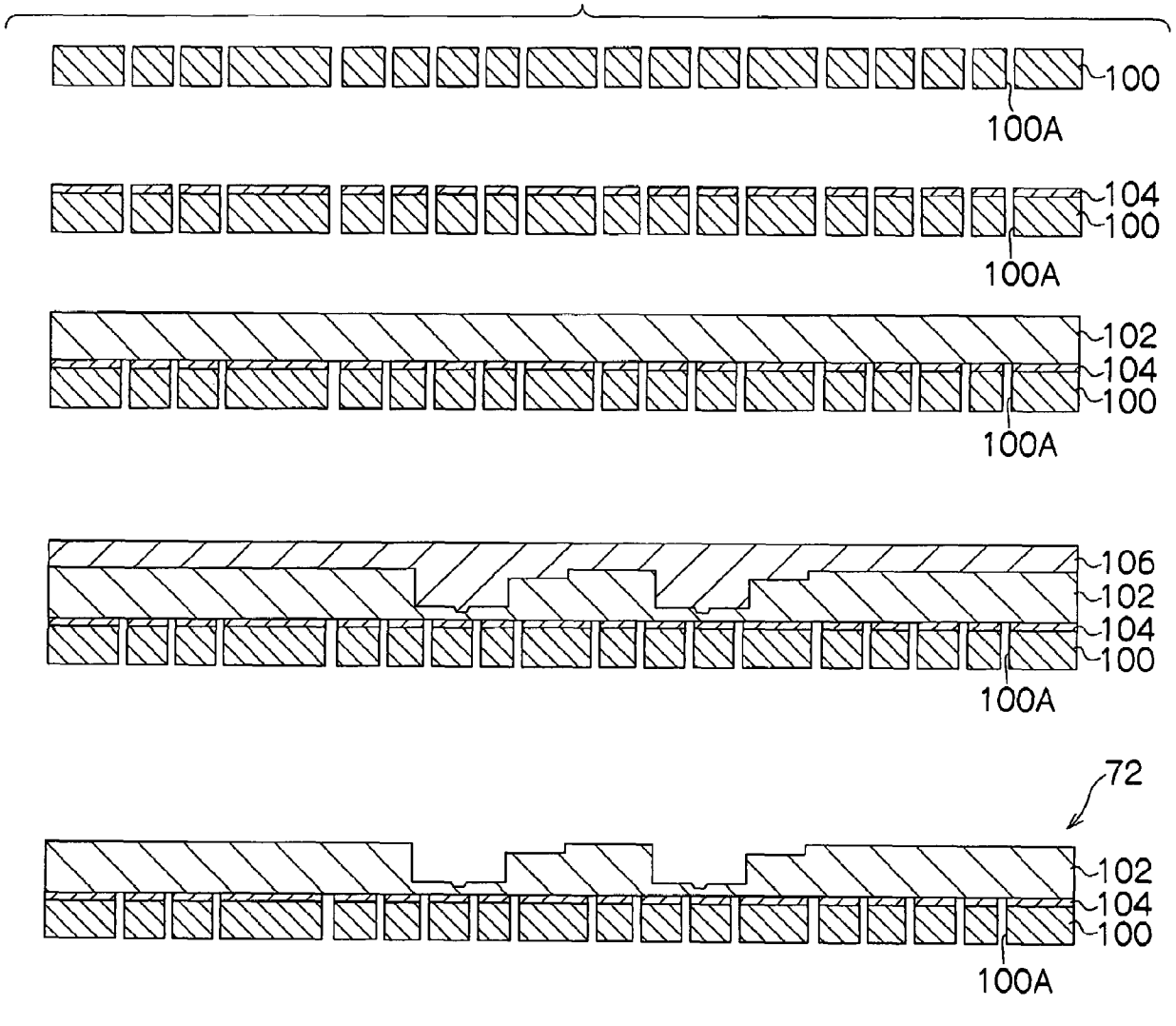
FIGS. 11A to 11E are explanatory diagrams showing processes for producing a flow path substrate.

With respect to the flow path substrate 72, as shown in FIG. 11A, first a second support substrate 100 that is made of glass and disposed with plural through-holes 100A is prepared. Similar to the first support substrate 76, any material may be used for the second support substrate 100 as long as it does not bend; this material is not limited to glass, but glass is preferable because it is hard and inexpensive. As the method of producing the second support substrate 100, femtosecond laser processing of a glass substrate and exposing/developing a photosensitive glass substrate (e.g., PEG3C produced by HOYA Co., Ltd.) are known.

Then, as shown in FIG. 11B, an adhesive 104 is applied to the upper surface of the second support substrate 100, and as shown in FIG. 11C, a resin substrate 102 (e.g., amide imide substrate with a thickness of 0.1 mm to 0.5 mm) is adhered to the upper surface of the adhesive 104. Next, as shown in FIG. 11D, the upper surface of the resin substrate 102 is pressed against a mold 106 and heated/pressurized. Thereafter, as shown in FIG. 11E, the mold 106 is released from the resin substrate 102, whereby the flow path substrate 72, in which the pressure chambers 50 and the nozzles 56 are formed, is completed.

Figure 12A:
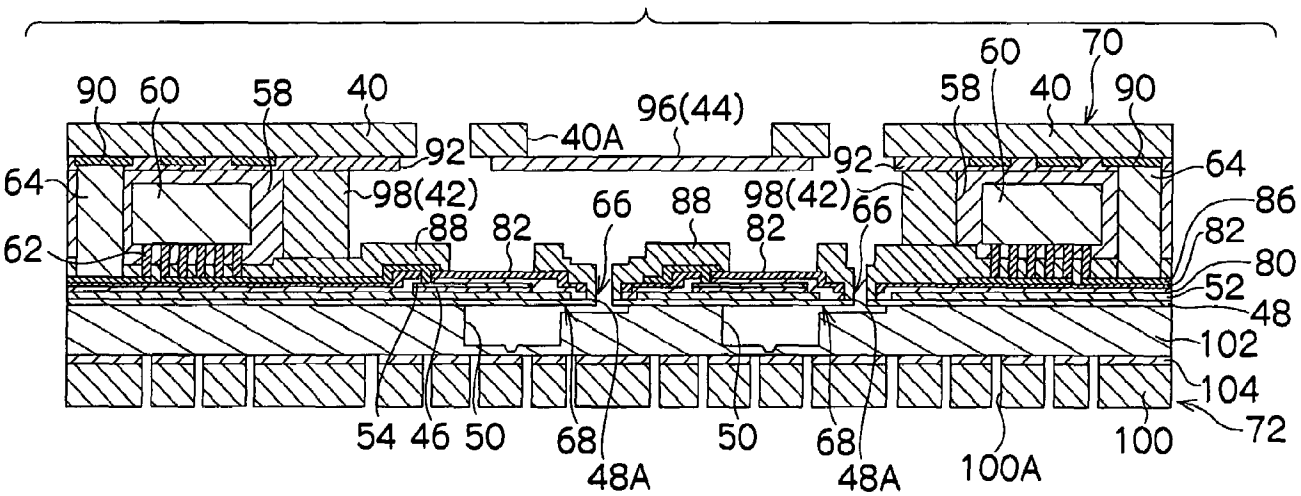
FIGS. 12A to 12E are explanatory diagrams showing processes for bonding the flow path substrate to the piezoelectric element substrate.
Figure 12B:
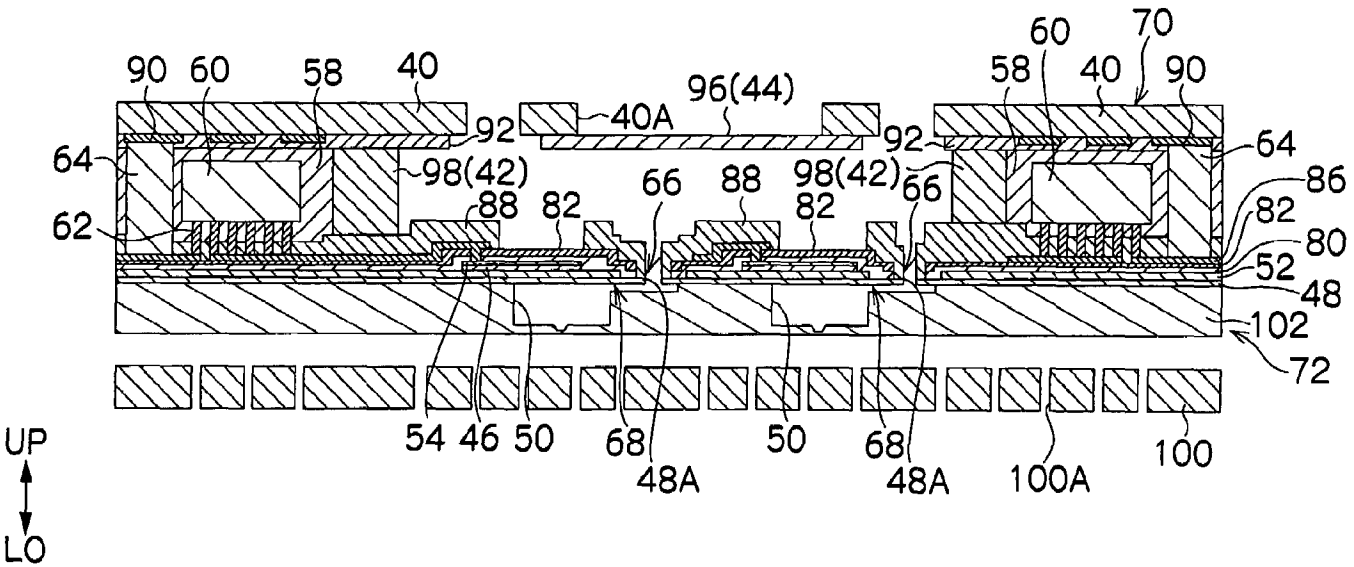

When the flow path substrate 72 is completed in this manner, as shown in FIG. 12A, the piezoelectric element substrate 70 and the flow path substrate 72 are coupled (bonded) together by thermocompression. Next, as shown in FIG. 12B, an adhesive separating solvent is injected through the through-holes 100A in the second support substrate 100 to selectively dissolve the adhesive 104, whereby the second support substrate 100 is separated from the flow path substrate 72.

Figures 12C, 12D, 12E:
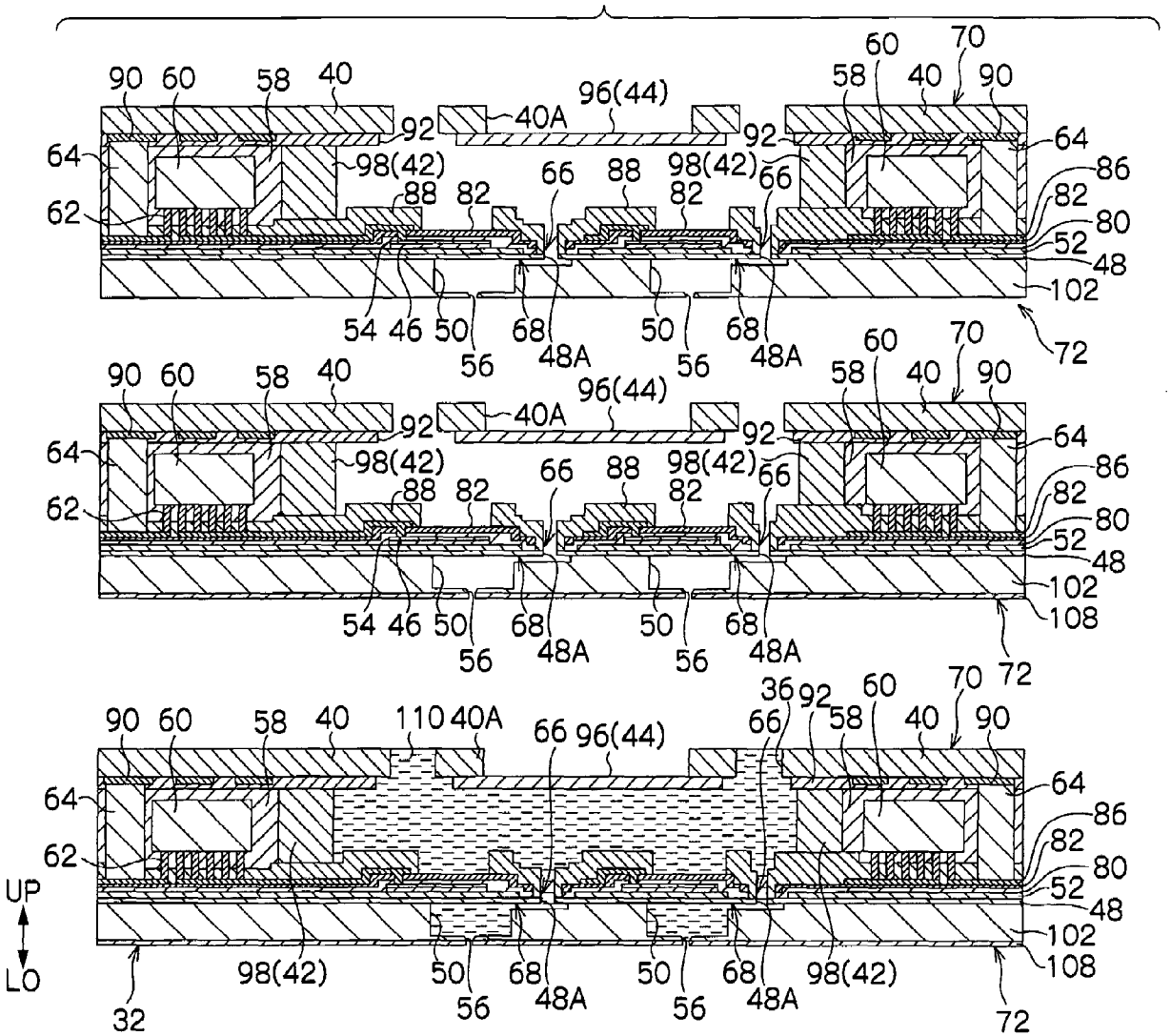

Thereafter, as shown in FIG. 12C, the surface from which the second support substrate 100 has been separated is polished using a polishing agent having alumina as a main component or etched by RIE using oxygen plasma, whereby the surface layer is removed and the nozzles 56 are opened. Then, as shown in FIG. 12D, a fluorine agent 108 (e.g., Cytop produced by Asahi Glass Co.) serving as a water-repelling agent is applied to the lower surface in which the nozzles 56 are opened, whereby the inkjet recording head 32 is completed and, as shown in FIG. 12E, the ink pool chamber 38 and the pressure chambers 50 can be filled with the ink 110.

Figure 13A:
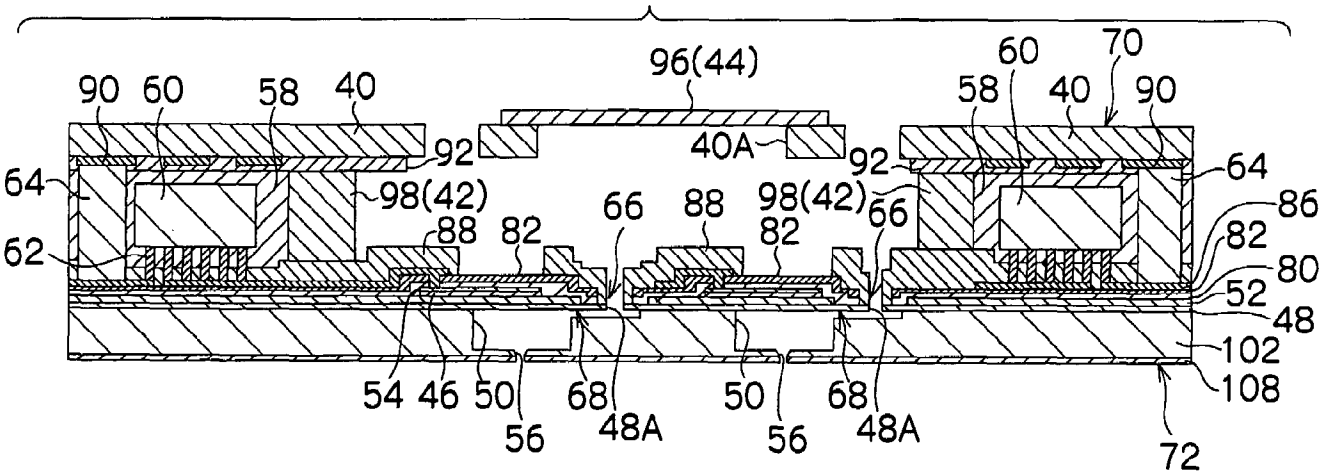
FIG. 13A is an explanatory diagram showing an inkjet recording head where the arrangement of the air damper is modified.
Figure 13B:
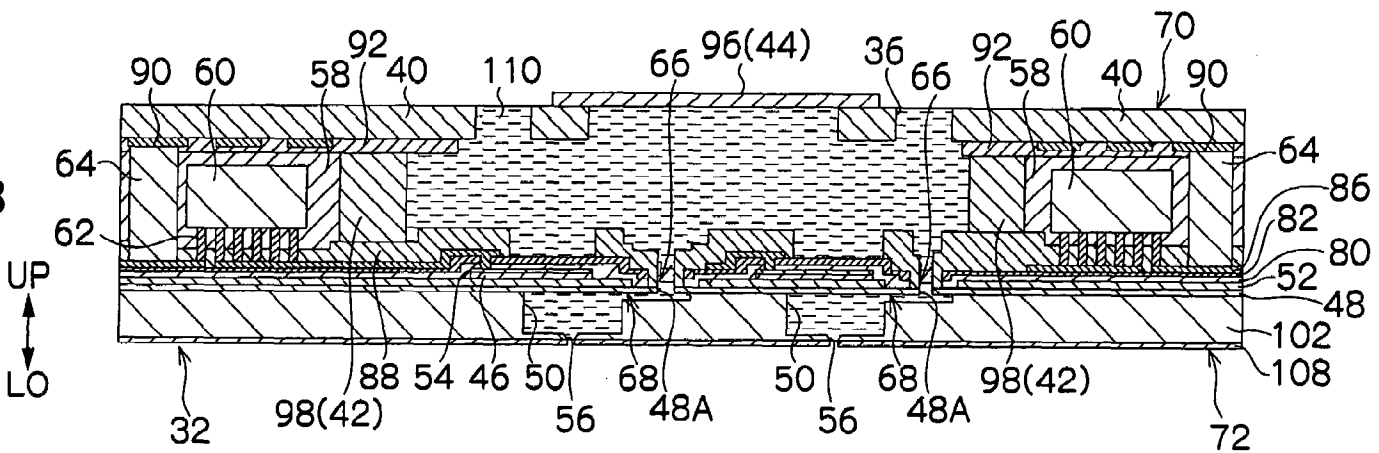
FIG. 13B is another explanatory diagram showing an inkjet recording head where the arrangement of the air damper is modified.
Figure 14:
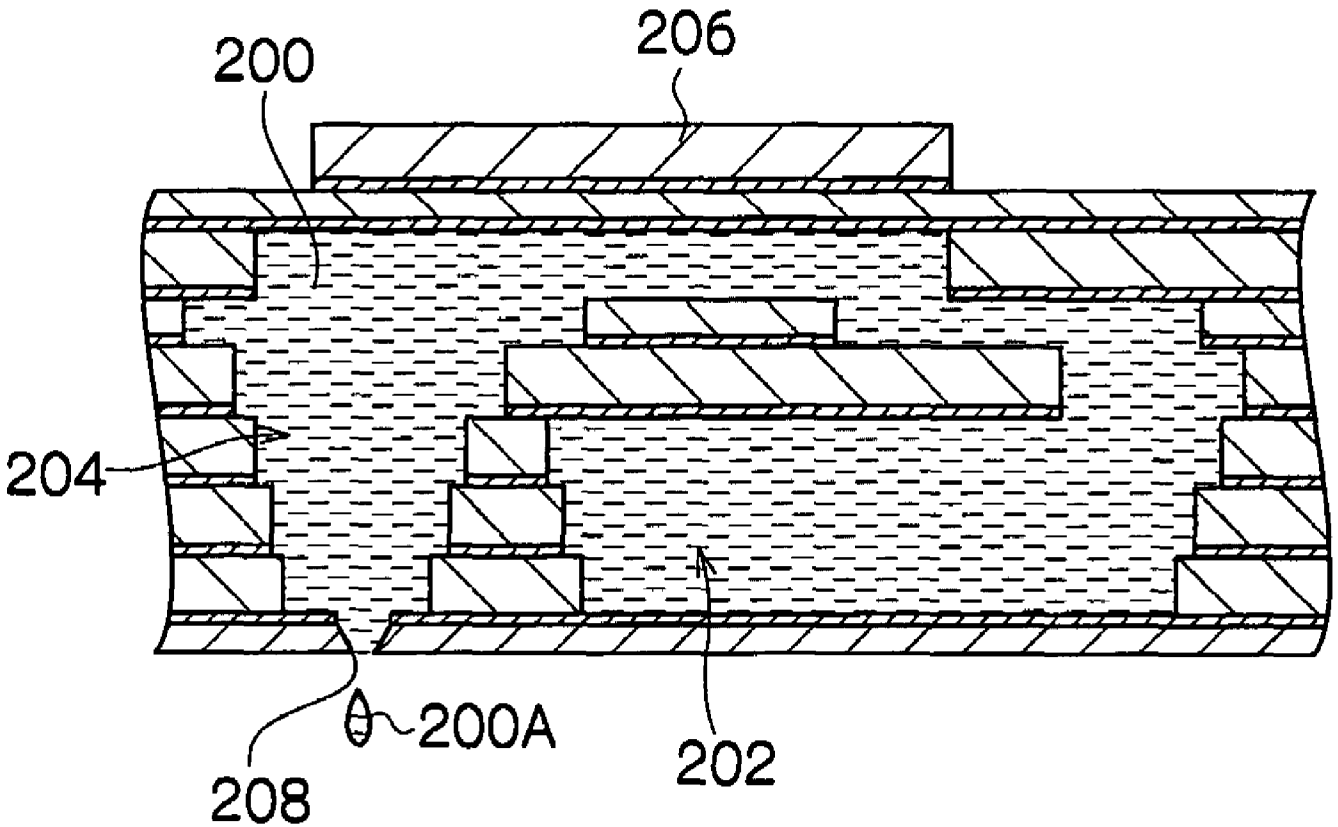
FIG. 14 is a schematic cross-sectional diagram showing the structure of a conventional inkjet recording head.
Figure 15:
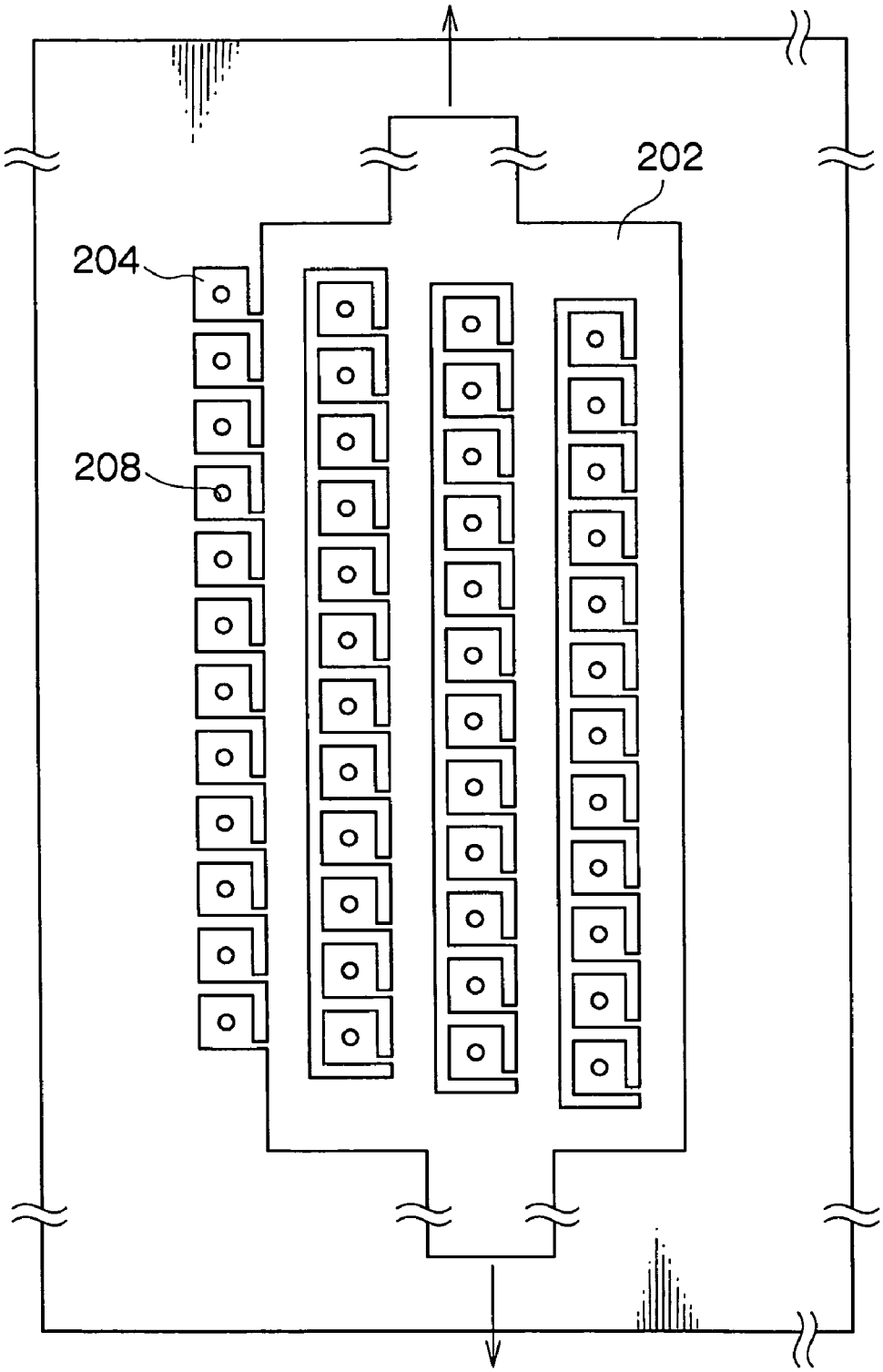
FIG. 15 is a schematic plan diagram showing the structure of the conventional inkjet recording head.
Figure 16A:
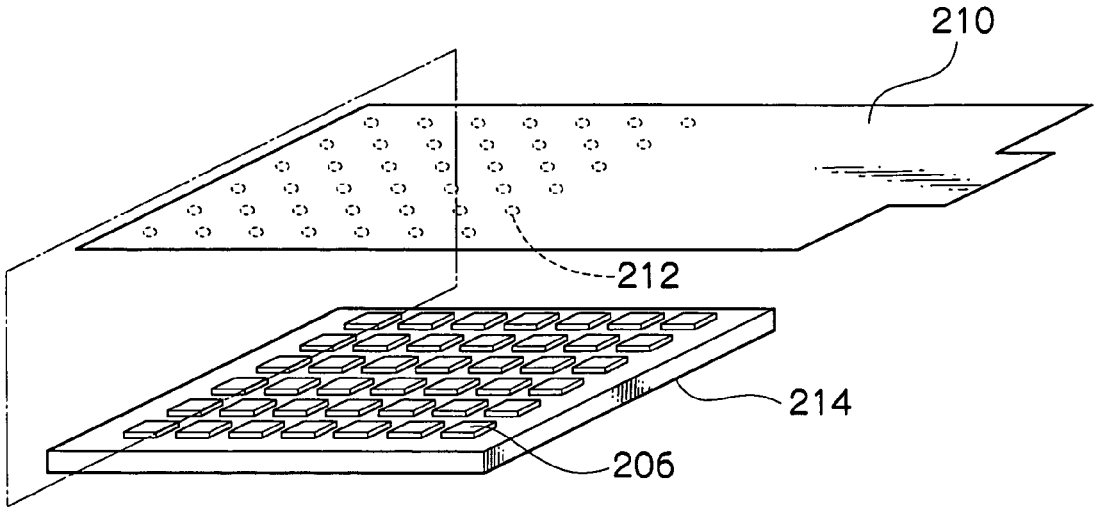
FIG. 16A is a schematic perspective diagram showing the structure of the conventional inkjet recording head.
Figure 16B:
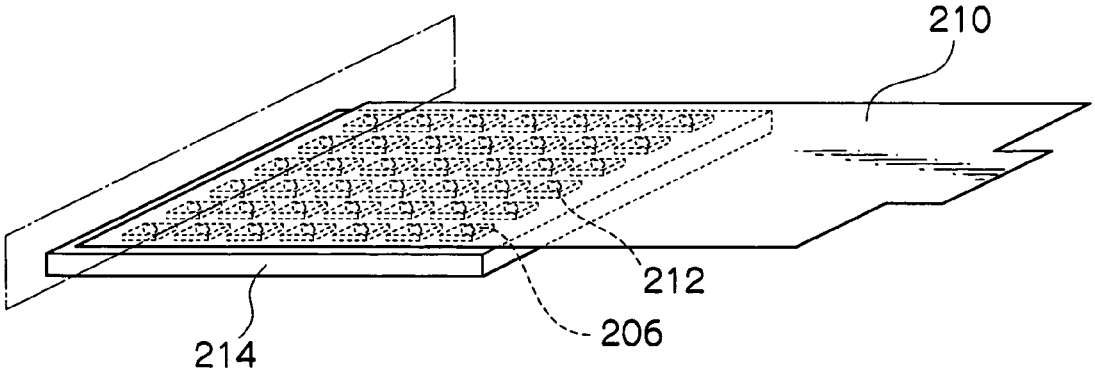
FIG. 16B is another schematic perspective diagram showing the structure of the conventional inkjet recording head.

It should be noted that the photosensitive dry film 96 (air damper 44) is not limited to being disposed inside the ink pool chamber 38 at the inner side of the top plate 40. For example, as shown in FIGS. 13A and 13B, the photosensitive dry film 96 (air damper 44) may also be disposed at the outer side of the top plate 40. Namely, the photosensitive dry film 96 (air damper 44) may be adhered to the top plate 40 from the outside of the ink pool chamber 38 immediately prior to the process of filling the ink pool chamber 38 with the ink 110.

The action of the inkjet recording device 10 disposed with the inkjet recording heads 32 produced as described above will next be described. First, when an electrical signal commanding printing is sent to the inkjet recording device 10, one sheet of the recording paper P is picked up from the paper supply tray 26 and conveyed to a predetermined position by the sub-scanning mechanism 18.

In the inkjet recording unit 30, the ink pool chambers 38 of the inkjet recording heads 32 are injected (filled) with the ink 110 from the ink tank 34 via the ink supply ports 36, and the ink 110 filling the ink pool chambers 38 is supplied (filled) to the pressure chambers 50 via the ink flow paths 66 and 68. Then, at this time, at the top ends (outlets) of the nozzles 56, a meniscus slightly recessed at the pressure chamber 50 side is formed in the surface of the ink 110.

Then, the ink droplets are selectively jetted from the plural nozzles 56 while the inkjet recording heads 32 loaded in the carriage 12 move in the main scanning direction, whereby part of an image based on image data is recorded in a predetermined band region of the recording paper P. Namely, a voltage is applied to predetermined piezoelectric elements 46 at a predetermined timing by the drive ICs 60 to cause the diaphragms 48 to flexibly deform in the vertical direction, pressurize the ink 110 inside the pressure chambers 50 and jet the ink 110 as ink droplets from predetermined nozzles 56.

When part of an image based on image data is recorded on the recording paper P in this manner, the recording paper P is conveyed at a predetermined pitch by the sub-scanning mechanism 18, and similar to above, the ink droplets are again selectively jetted from the plural nozzles 56 while the inkjet recording heads 32 are moved in the main scanning direction, whereby part of an image based on image data is recorded in the next band region of the recording paper P.

When the image based on image data is completely recorded on the recording paper P by repeatedly conducting the above operation, the recording paper P is conveyed by the sub-scanning mechanism 18 and discharged onto the paper discharge tray 28. Thus, printing (image recording) on the recording paper P ends.

Here, in each inkjet recording head 32, the ink pool chamber 38 is disposed at the opposite side (upper side) of the pressure chambers 50 with the diaphragm 48 (piezoelectric elements 46) disposed therebetween. In other words, the diaphragm 48 (piezoelectric elements 46) is disposed between the ink pool chamber 38 and the pressure chambers 50, so that the ink pool chamber 38 and the pressure chambers 50 do not exist on the same horizontal plane. Thus, the pressure chambers 50 are disposed in mutual proximity and the nozzles 56 are disposed in a high density.

The drive ICs that apply a voltage to the piezoelectric elements 46 are disposed between the diaphragm 48 and the top plate 40, and are not exposed (do not project) to the outside from the diaphragm 48 and the top plate 40 (i.e., the drive ICs are disposed inside the inkjet recording heads 32). Thus, the length of the metal interconnects 86 connecting the piezoelectric elements 46 and the drive ICs 60 can be shortened in comparison to a case where the drive Ics 60 are mounted on an exterior portion of the recording head 32, whereby low resistance of the metal interconnects 86 is realized.

In other words, high densification of the nozzles 56, i.e., a high-density matrix disposition of the nozzles 56 is realized with a practical interconnects resistance, whereby high-resolution becomes realizable. Moreover, because the drive ICs 60 are flip-chip-mounted on the piezoelectric element substrate 70 including the diaphragms 48 on which the piezoelectric elements 46 are formed, high-density interconnects connection can be easily done, and the height of the drive ICs 60 can be reduced (i.e., the drive ICs 60 can be thinned). Thus, miniaturization of the inkjet recording heads 32 is also realized.

Specifically, with an electrical connection resulting from the conventional FPC method, the limit on the nozzle resolution has been 600 npi (nozzle per pitch), but in the method of the present invention, a 1200 npi arrangement easily becomes possible. Also, with respect to size, an FPC does not have to be used, so that it becomes possible to make the size ½ or less in, for example, the case of the 600 npi nozzle arrangement.

Also, because the gaps at the peripheries of the drive ICs 60 are filled in with the resin material 58, the bonding strength between the top plate 40 and the piezoelectric element substrate 70 increases. Moreover, because the drive ICs 60 are sealed with the resin material 58, the drive ICs 60 can be protected from the external environment such as moisture. Also, because the metal interconnects 86 on the piezoelectric element substrate 70 connecting the piezoelectric elements 46 and the drive ICs 60 are covered with the resin protective film 88, erosion of the metal interconnects resulting from the ink 110 can be prevented. Moreover, because the resin protective film 88 and the resin film 82 covering the metal interconnects 86 by sandwiching the metal interconnects 86 therebetween are the same type of resin material, their coefficients of thermal expansion are substantially equivalent, whereby there is little occurrence of thermal stress.

In any event, a method is used where the piezoelectric element substrate 70 and the flow path substrate 72 configuring the inkjet recording head 32 are respectively produced on the support substrates 76 and 100, which are extremely hard, and during this production process, the support substrates 76 and 100 are removed at the points in time where the support substrates 76 and 100 become unnecessary. Thus, the configuration can be easily produced. Because the produced (completed) inkjet recording head 32 is supported by the top plate 40 (because the top plate 40 serves as a support), the rigidity thereof is ensured.

In addition, in the inkjet recording device 10 of the aforementioned embodiment, inkjet recording units 30 of the respective colors of black, yellow, magenta and cyan are loaded in the carriage 12, and ink droplets are selectively jetted from the inkjet recording heads 32 of the respective colors on the basis of image data so that a full color image is recorded on the recording paper P. However, the inkjet recording of the present invention is not limited to the recording of characters and images on the recording paper P.

Namely, the recording medium is not limited to paper, and the liquid that is jetted is not limited to ink. For example, the inkjet recording head 32 pertaining to the invention can be applied with respect to general industrially used liquid droplet jetting devices, such as jetting ink onto a polymer film or glass to create a display-use color filter, or jetting molten solder onto a substrate to form bumps for mounting parts.

The inkjet recording device 10 of the preceding embodiment is described by way of an example of a Partial Width Array (PWA) including the main scanning mechanism 16 and the sub-scanning mechanism 18, but the inkjet recording of the invention is not limited thereto. The so-called Full Width Array (FWA) corresponding to the paper width can also be used. Because the invention is effective for realizing a high-density nozzle arrangement, it is suitable for FWA requiring one-pass printing.

In any case, according to the invention, there can be provided an inkjet recording head where high densification of the nozzles and the formation of minute pitch interconnects required for the high densification of the nozzles are both realized so that high resolution and miniaturization are achieved.

What is claimed is:

1. An inkjet recording head comprising:

nozzles that jet ink droplets;

pressure chambers that communicate with the nozzles and contain ink;

a diaphragm that configures part of the pressure chambers;

an ink pool chamber that pools ink to be supplied to the pressure chambers via ink flow paths; and piezoelectric elements that cause the diaphragm to be displaced;

wherein the ink pool chamber is disposed opposite from the pressure chambers in a vertical direction with the diaphragm being sandwiched therebetween, and drive ICs that apply a voltage to the piezoelectric elements are mounted on a piezoelectric element substrate formed to include the diaphragm, and the drive ICs respectively have a plurality of bumps which are connected to the piezoelectric element substrate, and are disposed at an outer side of the ink pool chamber, wherein interconnects disposed at the piezoelectric element substrate and connecting the piezoelectric elements and the drive ICs have interconnects arrangement in which a pitch between each wire is 10 μm or less.

2. The inkjet recording head of claim 1, wherein the nozzles are disposed in a matrix.

3. The inkjet recording head of claim 1, wherein the drive ICs are surface-mounted on the piezoelectric element substrate.

4. The inkjet recording head of claim 1, wherein the drive ICs are disposed between the diaphragm and a top plate of the ink pool chamber.

5. The inkjet recording head of claim 4, wherein gaps of space in which the drive ICs are disposed, vertically between the diaphragm and the top plate, are filled in with a resin material.

6. The inkjet recording head of claim 4, wherein the drive ICs are disposed in proximity to a partition wall that is a side wall of the ink pool chamber.

7. The inkjet recording head of claim 1, wherein interconnects disposed at the piezoelectric element substrate and connecting the piezoelectric elements and the drive ICs are covered with a resin material.

8. The inkjet recording head of claim 7, wherein the interconnects are covered by being sandwiched between two resin layers whose coefficients of thermal expansion are substantially equivalent.

9. An inkjet recording head comprising:

nozzles that jet ink droplets;

pressure chambers that communicate with the nozzles and contain ink;

a diaphragm that configures part of the pressure chambers;

a piezoelectric element substrate formed to include the diaphragm;

an ink pool chamber that pools ink to be supplied to the pressure chambers and is demarcated by the piezoelectric element substrate, a top plate substantially parallel to the piezoelectric element substrate and a partition wall substantially perpendicular to the piezoelectric element substrate;

piezoelectric elements that cause the diaphragm to be displaced; and drive ICs that apply a voltage to the piezoelectric elements, wherein the ink pool chamber is disposed opposite from the pressure chambers in a vertical direction with the diaphragm being disposed therebetween, and the drive ICs are disposed in proximity to the partition wall of the ink pool chamber and between the piezoelectric element substrate and the top plate, and the drive ICs respectively have a plurality of bumps which are connected to the piezoelectric element substrate, and are disposed at an outer side of the ink pool chamber, wherein interconnects disposed at the piezoelectric element substrate and connecting the piezoelectric elements and the drive ICs have interconnects arrangement in which a pitch between each wire is 10 μm or less.

10. The inkjet recording head of claim 9, wherein the drive ICs are mounted on the piezoelectric element substrate.

11. The inkjet recording head of claim 10, wherein the drive ICs are surface-mounted on the piezoelectric element substrate.

12. The inkjet recording head of claim 9, wherein the nozzles are disposed in a matrix.

13. The inkjet recording head of claim 12, wherein the arrangement of the nozzles is at least a 1200 npi arrangement.

14. The inkjet recording head of claim 9, wherein spaces between the piezoelectric element substrate and the top plate and in which the drive ICs are disposed are filled in with a resin material.

15. The inkjet recording head of claim 9, wherein interconnects disposed at the piezoelectric element substrate and connecting the piezoelectric elements and the drive ICs are covered with a resin material.

16. The inkjet recording head of claim 15, wherein the interconnects are covered by being sandwiched between two resin layers whose coefficients of thermal expansion are substantially equivalent.

* * * * *